US012083414B1

(12) United States Patent
Curley

(10) Patent No.: US 12,083,414 B1
(45) Date of Patent: Sep. 10, 2024

(54) REDUCED-COST CARD SHUFFLER

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

(21) Appl. No.: 18/737,988

(22) Filed: Jun. 8, 2024

(51) Int. Cl.
*A63F 1/12* (2006.01)
*A63F 1/06* (2006.01)
*A63F 1/14* (2006.01)

(52) U.S. Cl.
CPC *A63F 1/12* (2013.01); *A63F 1/06* (2013.01); *A63F 1/14* (2013.01)

(58) Field of Classification Search
CPC ..... A63F 1/12; A63F 1/14; A63F 1/06
USPC ..... 273/149 R
See application file for complete search history.

(56) References Cited

U.S. PATENT DOCUMENTS 1,885,276 A 11/1932 McKay
2,755,090 A 7/1956 Aldrich
2,815,214 A 12/1957 Hall
3,260,520 A 7/1966 Sugden
3,771,783 A 11/1973 McInerny
3,897,954 A 8/1975 Erickson
4,513,969 A 4/1985 Samsel
4,586,712 A 5/1986 Lorber
4,770,421 A 9/1988 Hoffman
4,969,648 A 11/1990 Hollinger
5,000,453 A 3/1991 Stevens
5,445,377 A 8/1995 Steinbach
5,718,427 A 2/1998 Cranford
6,149,154 A 11/2000 Grauzer
6,254,096 B1 7/2001 Grauzer
6,655,684 B2 * 12/2003 Grauzer ..... A63F 1/12 273/149 P
6,659,460 B2 12/2003 Blaha
7,059,602 B2 6/2006 Grauzer
7,073,791 B2 7/2006 Grauzer
7,255,344 B2 * 8/2007 Grauzer ..... A63F 1/12 273/149 R
7,261,294 B2 8/2007 Grauzer
7,338,044 B2 3/2008 Grauzer
7,500,672 B2 3/2009 Ho
7,766,333 B1 8/2010 Stardust
7,900,923 B2 3/2011 Toyama
8,267,404 B2 9/2012 Grauzer
(Continued)

*Primary Examiner* — Allen Chan
(74) *Attorney, Agent, or Firm* — Chris Tanner; BluecollarIP.com

(57) ABSTRACT

A card handling apparatus and method of manufacture and assembly is used for creating pre-formed hands for use in casino poker games whereupon the apparatus may be programmed to accommodate a number of different game variations, and a differing number of players, is disclosed. The apparatus comprises an unshuffled card input portal, a shuffled card discharge portal and an elevator having a plurality of card storage nests whose operation utilizes inertial forces. The exploitation of inertial forces allows the apparatus to be operated without the need for the motorized card pusher mechanisms which are prevalent in the prior art, thus creating a card handling apparatus that is more compact and requires less manufacturing cost. In comparison to prior art hand-forming shufflers which typically utilize five or six motors, the preferred embodiment utilizes just two motors. A method of rotating the axis of individual playing cards during nest insertion is also taught.

24 Claims, 22 Drawing Sheets

(56) References Cited

U.S. PATENT DOCUMENTS

| | | | | |
|---|---|---|---|---|
| 8,342,526 | B1 | 1/2013 | Sampson | |
| 8,353,513 | B2 | 1/2013 | Swanson | |
| 8,366,109 | B2 * | 2/2013 | Soltys | A63F 1/10 273/149 P |
| 8,419,016 | B2 | 4/2013 | Yoseloff | |
| 8,579,289 | B2 * | 11/2013 | Rynda | A63F 1/12 273/149 R |
| 8,651,486 | B2 | 2/2014 | Grauzer | |
| 8,702,100 | B2 | 4/2014 | Snow | |
| 9,474,957 | B2 | 10/2016 | Haushalter | |
| 11,338,194 | B2 * | 5/2022 | Helgesen | A63F 1/12 |
| 2020/0171375 | A1 * | 6/2020 | Litman | A63F 1/12 |
| 2024/0009547 | A1 | 1/2024 | Oeding | |

* cited by examiner

REDUCED-COST CARD SHUFFLER

FIELD OF INVENTION

The present invention is related to the field of casino grade automatic card shuffling machines, which are used by casinos to speed up the rate of play of dealer-hosted card games. More particularly, the invention relates to shuffling machines which randomize the rank and suit of cards within a single deck of playing cards in order to form "hands" for use in various types of poker games. These shuffler types are called "hand forming" shufflers in the art because they dispense groups of play-ready cards to an exit portal, whereupon a casino dealer issues one shuffled hand to each player at the initiation of a poker game. The groups of play-ready cards are herein referred to as "substacks".

BACKGROUND

Stud poker games such as Let it Ride®, Three-Card Poker®, or Caribbean Stud® are major attractions in casino poker rooms because they are relatively easy to play and allow wagering to various degrees of risk. A single deck of 52 playing cards is used in these games, which must be periodically shuffled to effect randomness of the rank and suit of the individual cards within the deck. Each poker game is initiated by delivering a shuffled (randomized) hand of playing cards to each game participant. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

"Hand-forming" shufflers quickly randomize card decks by sorting them into shuffled substacks within compartments which reside within the apparatus. Upon dealer request, each substack is delivered to an exit portal where a dealer may issue that hand to a player. The hand-forming shufflers are programmable such that the number of cards in each substack may be adjusted for individual card games, and also for the number of players. For example, various forms of five-card stud poker will be initiated with hands of five cards, while games such as Three-Card Poker® are played with hands of only three cards.

FIG. 1 illustrates an early "hand-forming" playing card shuffler that was described in a 1932 patent granted to R. C. Mckay and issued as U.S. Pat. No. 1,885,276 (Mckay '276). Groups of individual playing cards are accumulated into substacks in four compartments which are configured radially in a rotating carrier. FIG. 1 is reproduced from the Mckay '276 patent which explains that individual cards are separated from an unshuffled deck and randomly accumulated into four compartments. The substacks of cards are retained in each compartmental nest by gravity, and the substacks must be removed from their nests by displacing the card carrier so that the cards may be removed in the same direction from which they were inserted.

Referring to FIG. 1, the rotational housing which carries the four compartments is called the "receiver" 1024, which possesses four compartments 1025 through 1028 for accumulating substacks of randomly selected cards. The receiver 1024 rotates about pivot 1032 to one of four randomly chosen radial positions. A deck of cards is placed into the sloped magazine 1001 which utilizes rubber-tired wheels 1003 to strip individual cards from the bottom of the stack and move them through a slotted opening 1050 under the power of a hand crank. An innovative random selection mechanism using small balls of four sizes is used to randomly position the receiver 1024 to one of four radial positions for collecting the individual cards into compartments 1025 through 1028.

Mckay '276 appears to have pioneered the concept of "shuffling" cards by distributing individual cards randomly into a myriad of compartments. Indeed, the 1932 patent is entitled AUTOMATIC CARD SHUFFLER AND DEALER, and teaches an innovative randomizing configuration which was implemented without the aid of motors or microcontrollers.

A later shuffler patent is known in the industry as the "Lorber Design" and was taught by U.S. Pat. No. 4,586,712 (Lorber '712), which was granted in 1986. This classic configuration (shown in FIG. 2) is based upon unloading cards from an unshuffled deck into the individual slots of a carousel, randomly rotating the carousel, and then pushing individual cards from the carousel slots and into a shoe. Each slot in the Lorber '712 carousel holds one card.

As shown in the upper section of FIG. 2, an unshuffled card stack 2053 is deposited on edge into container 2052 of the automatic shuffling apparatus 2050. Individual cards are vertically stripped from the stack and moved downward from the left end of container 2052 and into a carousel 2062 by driven rollers 2054 and 2055. The carousel 2062 is described as a storage device 2060 which possesses a series of radially arranged addressable spaces 2064 which can be aligned with the edges of card stack 2053 of container 2052 for the purpose of inserting a card. A computer rotates a stepper motor (not shown) to insert cards in any random space within the carousel 2062. Individual cards are extracted from the randomly rotated carousel 2062 at the station shown in the bottom left section of the figure by the action of an "ejecting device" 2066. Driven rollers 2054 and 2055 move the individual cards into a newly created stack within the space 2068. The stack of cards within discharge portal 2068 has thus been arranged randomly (shuffled).

Rather than arranging the card storage compartments within a circular carousel, other early shufflers utilized compartments configured in a vertical stack. 1988 U.S. Pat. No. 4,770,421 to Lionel Hoffman (Hoffman '421) teaches a stack of "mixing pockets". Referring to FIG. 3A, which is reproduced and annotated from that patent, the six mixing pockets 934A through 934F are arranged in a linear stack. The Hoffman '421 specification explains that cards are individually inserted into a randomly chosen compartment within the stack of mixing pockets, accumulated, and then extracted in groups from the mixing pockets in a random order. The specification explains;

> According to a more particular form of the invention, a card shuffler is provided comprising a plurality of mixing pockets for holding cards, and card holding and distribution means for holding a stack of cards and for distributing and transferring one card at a time in sequence to said mixing pockets in accordance with a first distribution schedule. (Hoffman '421 1:61-67)

The compartment shuffler art has since generally evolved into myriads of disclosures that are characterized by their storage compartment configurations. A large group of more recent shuffler disclosures utilize linear stacks and elevators, and another large group of more recent disclosures utilize circularly arranged storage exemplified by drums and carousels.

A more recent "hand-forming" shuffler is taught by U.S. Pat. No. 6,659,460 which was granted in 2003 to Ernst Blaha (Blaha '460), as shown in FIG. 3B. Blaha '460 also incorporates a carousel configuration which is similar to the Lorber design, but Blaha '460 differs from its predecessor by configuring the carousel slots to accumulate multiple cards. In this way, Blaha is used as a hand forming shuffler.

Referring to FIG. 3B, unshuffled cards 313 residing in an unshuffled card station 310 (upper left) are transported by feed rollers 314, 315, 318 and 319 into compartments 369 of the "rotatably held drum" 302. The rollers 318 and 319 are unable to fully insert the cards into the compartments, thus requiring a first pusher 316 which is driven by a motor 323 through eccentric link 322. The pusher 316 pushes each card through the final small movement into the compartments 369 of the drum 302. The drum is rotated by motor 308 to random loading positions as commanded by a microprocessor such that each compartment may accumulate a series of randomly selected cards.

The drum compartments are unloaded to a second station 342 by a second pusher linkage 335 and 337 which is actuated by a motor-driven eccentric 338. After each card is pushed sufficiently into the friction rollers 340 and 345, those rollers move the cards to the "card storage means" 342, as driven by motor 341. Blaha '460 uses two motors to insert each card into the drum, and another two motors to extract the substacks. When including the motor required to selectively rotate the carousel, Blaha '460 teaches the need for at least five (5) motors.

U.S. Pat. No. 6,149,154 was granted to Attila Grauzer et al in 2000 (Grauzer '154) and describes another "hand-forming" shuffler where the carousel compartments are unwound into the form of a linear elevator. The elevator consists of card accumulation compartments which are moved linearly rather than rotationally. FIG. 4 shows an illustration reproduced from the '154 patent showing the side view of the device, including the "hand receiving platform" 836, the "card moving mechanism" 830, the "rack assembly" 828, and the card receiver 826 "for receiving a group of cards for being formed into hands". Operation is understandingly similar to the carousel devices. Cards are randomly inserted into slots of the elevator at one station, and thereafter randomly pushed from slots at another station. Cards cannot be moved directly from the input portal to the discharge portal.

Referring to FIG. 4, Grauzer '154 teaches an elevator with nine compartments called a "rack assembly" which traverses up and down in the direction of arrow 884. Unshuffled card decks are placed into the unshuffled card receiver 826 against the surface 870 of a moveable block 868, and individually propelled in direction of arrow 882 by motorized rollers 850, 862 and 864 into the compartments of the rack assembly 828 at the loading station 830. An elevator motor 842 and timing belt 840 move the rack assembly upwards and downwards to align randomly chosen compartments with arrow 882. Thereafter, each card is inserted into a randomly chosen compartment and temporarily accumulated with others. A microcontroller counts the number of cards inserted into each randomly chosen compartment. When a given compartment reaches the capacity of cards required for a hand, no more cards are entered into that compartment, and the compartment is considered ready. When enough compartments are filled to the hand capacity needed for the number of players, the shuffler is then ready to disgorge substacks (hands). A pusher mechanism 890 is located at a lower station and used to push the substacks out of the compartments in the direction of arrow 886 and into the "hand receiving platform" 836. In comparison to the carousel shuffler designs, Grauzer '154 teaches that only nine (9) compartments are required for proper randomization in a hand forming shuffler.

In the Grauzer '154 configuration, the substacks are retained within each elevator compartment by gravity. Thus, a motorized "pusher mechanism" is needed for removing the substacks from the elevator compartments to the hand receiving platform 836. FIG. 5 is a reproduction from another figure of the Grauzer '154 patent that explains the card removal pusher mechanism in more detail. The elevator positions the compartment requiring extraction at a level occupied by a "pusher' mechanism as aligned with arrow 886. The substacks are thereafter pushed out of the compartment 892 and into the hand receiving platform 836. The pusher must move the distance of about two cards in the forward direction and then move another approximately two cards distance during the withdrawal stroke. Grauzer '154 describes the pusher 890 as a "rack". The passage below paraphrases a section of the Grauzer disclosure where the label numerals are altered to the equivalent labels used herein.

> The pusher 890 includes a substantially rigid pusher arm in the form of a rack having a plurality of linearly arranged apertures along its length. The arm 890 operably engages the teeth of a pinion gear 896 driven by an unloading motor 898, which is in turn controlled by the microprocessor. At its leading or card contacting end, the pusher arm 890 includes a blunt, enlarged card-contacting end portion. ('154 12:56-67)

Grauzer '154 describes the well-known commercialized "hand forming" shuffler manufactured by ShuffleMaster, called the ACE Shuffler®. The elevator is referred to as a "rack assembly" in the disclosure and consists of eight "hand forming" compartments and a ninth oversized compartment for accumulating the unused cards which remain after all of the required hands have been formed. The oversized compartment is located centrally within the elevator and indicated by label 894 in FIG. 5. The disclosure explains that eight compartments are sufficient for statistical randomization of a deck (52 cards) in the following paraphrased passage.

> Preferably, the rack assembly 828 has nine compartments. Seven of the nine compartments are for forming player hands, one compartment forms dealer hands and the last compartment 894 is for accepting unused or discard cards. It should be understood that the device of the present invention is not limited to rack assembly with seven compartments. For example, although it is possible to achieve a random distribution of cards delivered to eight compartments with a fifty-two card deck or group of cards, if the number of cards per initial unshuffled group is greater than 52, more compartments than nine may be provided to achieve sufficient randomness in eight formed hands. ('154 8:66-67, 9:1-10)

The oversized compartment 894 shown in FIG. 5 is required to collect the unused cards from the unshuffled card receiver. The unused cards must be temporarily stored in the rack assembly because there is no direct path from the unshuffled card receiver to the hand receiving platform. That problem is resolved by the shuffler being disclosed herein, which eliminates the need for an oversized card storage compartment.

US patent application 2024/0009547A1 by Craig Walter Oeding (Oeding '547) describes another elevator-type hand-forming shuffler that inserts cards into the pockets of an elevator at one level and discharges cards from the pockets at a second level. The disclosure teaches the utilization of two pushers, one to push individual cards into the pockets of the elevator, and a second to push accumulated stacks of cards out of those pockets. FIG. 6 is reproduced and annotated from that patent application.

Referring to FIG. 6, unshuffled card stack C is placed into card infeed area 6070, where individual cards are moved from the bottom of the stack by feed rollers 6084 to a card receiver 6090 which consists of multiple stacked pockets 6092. An arm 6112 is connected to component 6118 which is described as a "crank mechanism driven by a motor". The arm 6112 has a stop portion 6114 which pushes the cards into the pockets 6192. A second pusher 6152 is utilized to push the cards out of pockets 6092 at an upper level. That pusher is driven by motor M5, and has a blunt face 6154 which pushes the cards all the way to the card dispensing area 6072. In addition, another motor M1 rotates a "moveable wall" 6080 which is utilized to contact the unshuffled card stack, resulting in downward pressure on the input card stack C. Two other motors, M2 and M3 are used to power the feed rollers 6084. In total, Oeding '547 describes a hand-forming shuffler that requires at least six (6) motors.

Machine designers who design electromechanical products are often tasked with the goal of redesigning a product with the specific goal of reducing manufacturing costs. In this way, that product can become more competitive in the marketplace. Such goals require reducing the number of parts and especially reducing the number of motors. Motor-driven mechanisms are attractive targets in cost reduction efforts because such mechanisms are surrounded by significant cost burden including home sensors, motor driver integrated circuits and software overhead, in addition to the significant cost burden of the motor itself. In the specific case of cost reducing hand forming shuffling machines, the designer will seek to reduce the number of motor driven mechanisms and also to reduce the number of compartments. Secondary cost reductions will accrue from shrinking printed circuit board size and reducing the overall size of the product, which reduces the cost of the structural frames and outer jacketing.

The low-cost shuffler described herein is intended to introduce a more competitive hand-forming shuffler than those which are referenced in the prior art, by achieving discernable manufacturing cost reductions. The shuffler design within this disclosure achieves these manufacturing cost reduction goals by eliminating the need for motorized pusher mechanisms and reducing the number of required compartments, thus achieving a hand-forming shuffler device that requires less parts, is more compact and is more economical to manufacture than the referenced prior art. For example, the Grauzer '154 disclosure (ShuffleMaster ACE® Shuffler) describes the need for five motors and one solenoid ('154 Column 16, Appendix A). The other cited hand-forming shuffler art teaches the need for five or six motors. Comparatively, the preferred embodiment described herein requires only two motors and one solenoid.

The device herein advantageously utilizes inertial force to retain, align and discharge the card substacks in angulated nests, thus eliminating the need for motorized pusher mechanisms. Since there is no time required for the comparatively long retraction stroke of a pusher mechanism, the hand delivery response of the preferred embodiment can be quicker. The shuffler described herein also allows cards to be moved directly from the input portal to the output portal without requiring elevator motion or temporary storage within the nests, a feature which has multiple advantages.

The unique features and cost efficiency advantages of this shuffler configuration will become better understood with reference to the descriptions, drawings and claims which are presented below.

DETAILED DESCRIPTION

Figure 1:
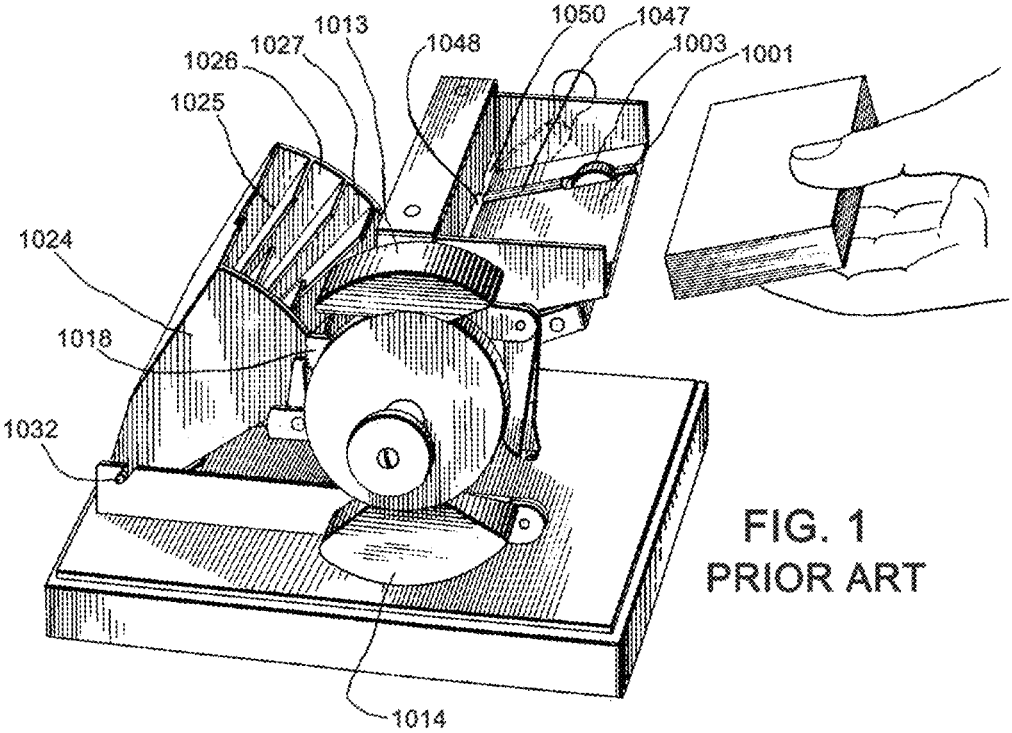
FIG. 1 PRIOR ART
FIG. 1 is a perspective view from an early (1932) hand-forming shuffler patent.
Figure 2:
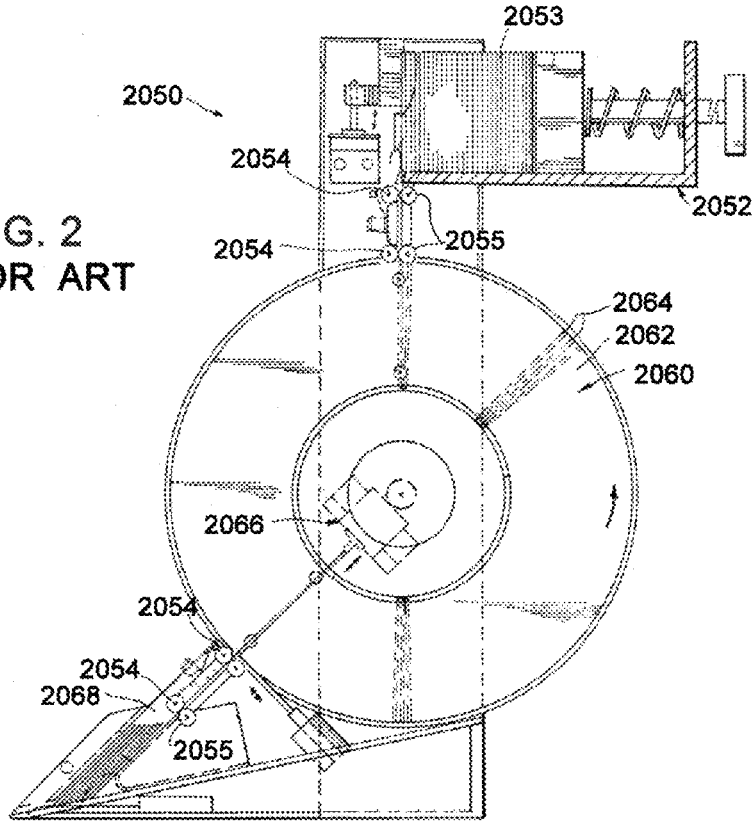
FIG. 2 PRIOR ART
FIG. 2 is a perspective view from a prior art (1986) carousel shuffler patent disclosure.
Figure 3A:
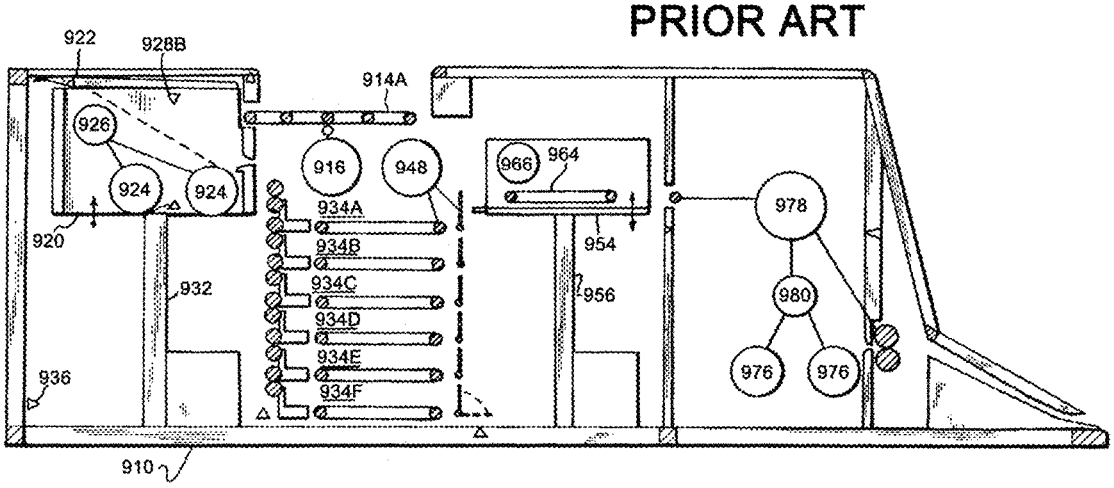
FIG. 3A PRIOR ART
FIG. 3A is a side elevation view from a prior art (1988) elevator shuffler patent disclosure.
Figure 3B:
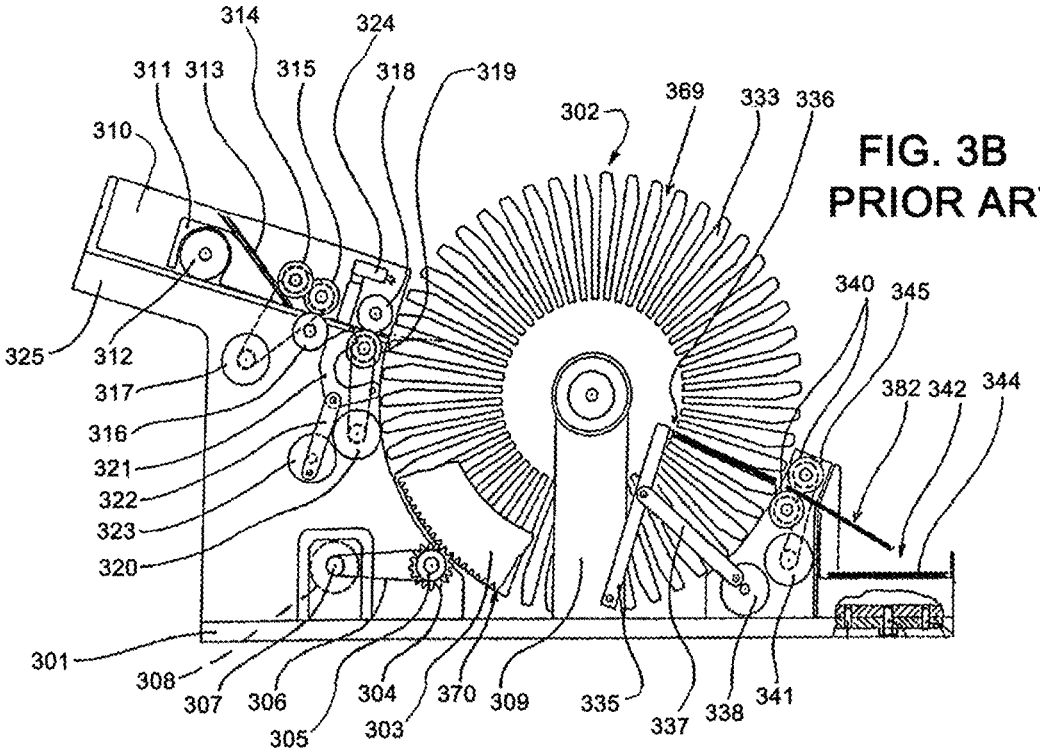
FIG. 3B PRIOR ART
FIG. 3B is a side elevation view from a prior art (2003) carousel shuffler patent disclosure.
Figure 4:
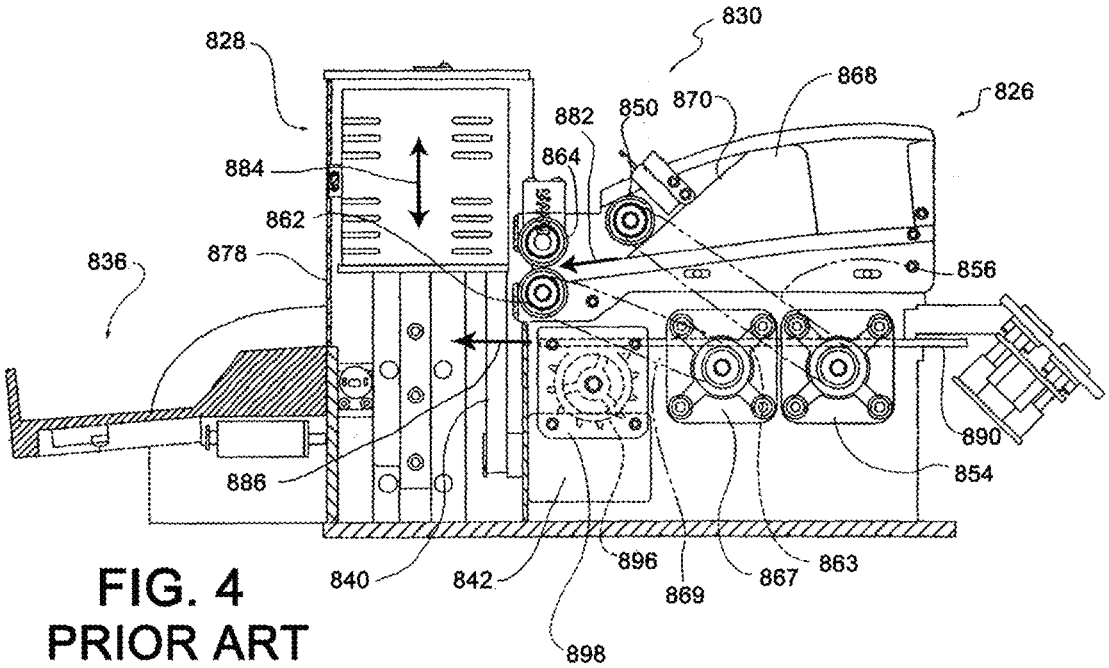
FIG. 4 PRIOR ART
FIG. 4 is a side elevation view from a prior art (2000) elevator shuffler patent disclosure.
Figure 5:
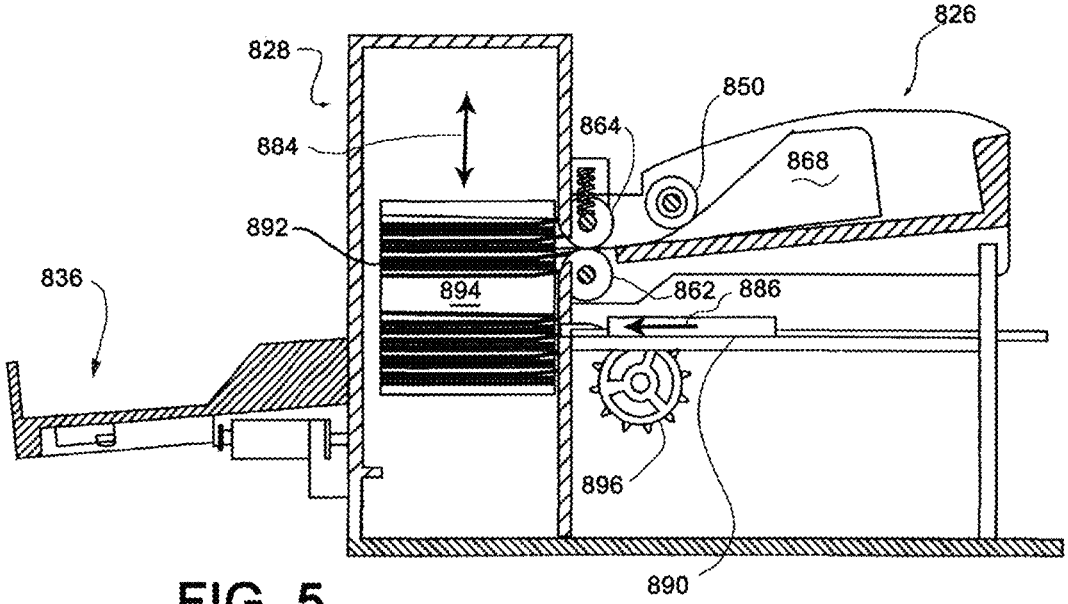
FIG. 5 PRIOR ART
FIG. 5 is another view from the prior art carousel shuffler patent disclosure in FIG. 4.
Figure 6:
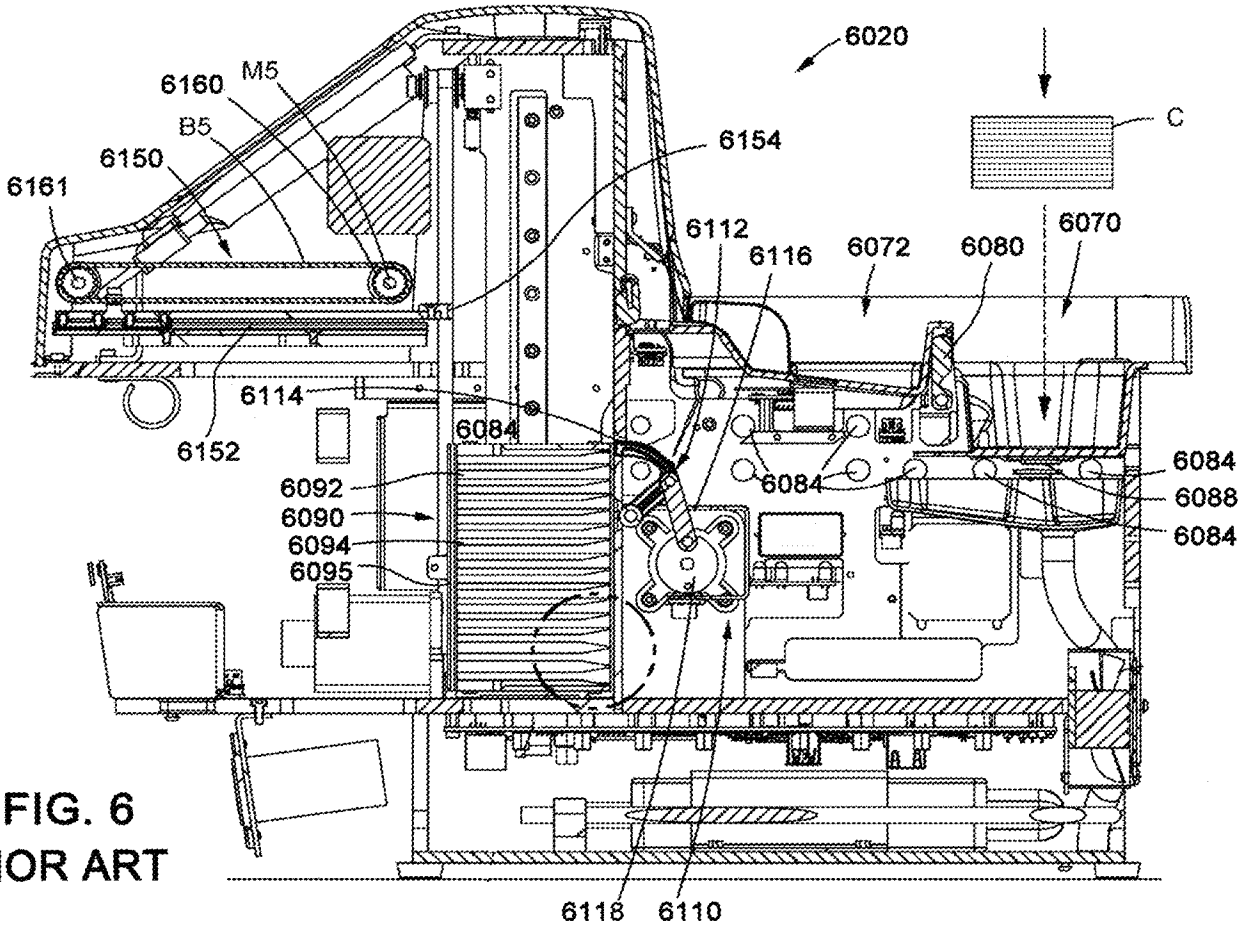
FIG. 6 PRIOR ART
FIG. 6 is side elevation view from a prior art patent application (2023) which teaches an elevator-type hand-forming shuffler.
Figure 7:
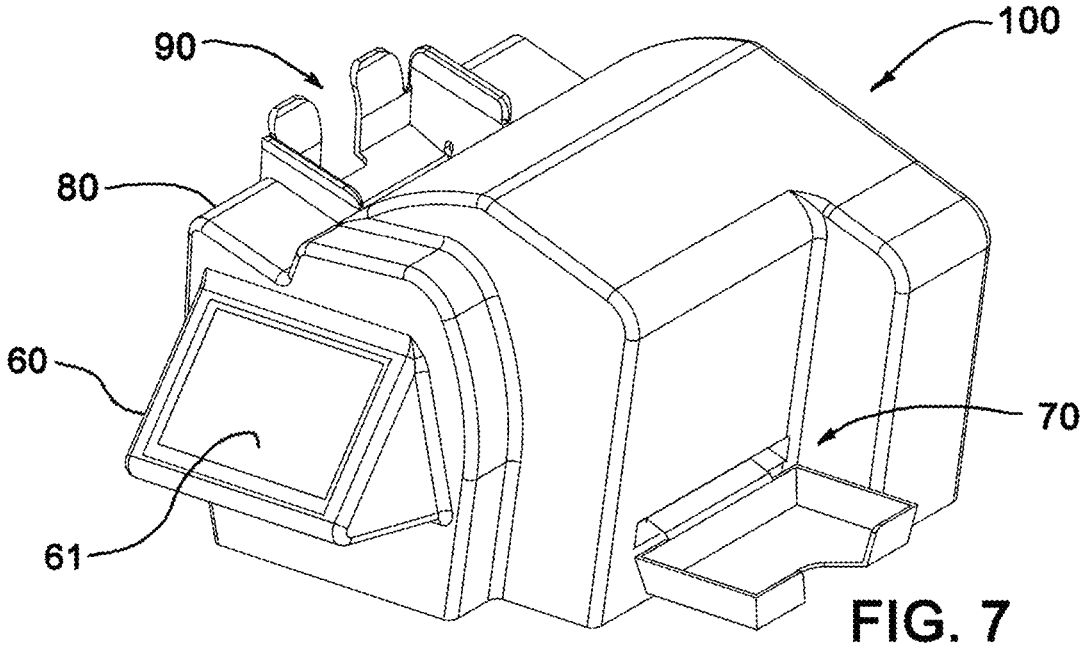
FIG. 7 is a perspective view of a preferred embodiment of the present invention as it might appear in a casino poker room.

FIG. 7 illustrates a preferred embodiment of the low-cost shuffler device disclosed herein as it might appear in the poker room of a casino. The shuffler 100 possesses a housing 80 and a control panel 60 which is positioned conveniently on an exterior of the housing, positioned to be conveniently viewable by a casino dealer. At least one microcontroller 84 (not shown) controls the operation of the shuffler 100, including operation of the control panel 60. In an embodiment, the control panel 60 can have a small e.g. 5-inch touchscreen 61 that is used to program the shuffler for various poker games. For size reference, a 5-inch touchscreen is slightly smaller than the smaller touchscreens used in today's mobile phones. Prior to each game, the dealer will utilize the touchscreen 61 to program the shuffler 100 to produce the required number of cards in each hand as required by various forms of poker. Additionally, the dealer will program the shuffler 100 to issue N hands, where N is the number hands needed for the game. The touchscreen 61 will also indicate possible malfunctions and security issues to the dealer. For example, the microcontroller counts the number of cards sorted in each deck and will issue a warning on the touchscreen if that number is unexpected due to player or dealer cheating.

Input portal 90 is designed to receive and hold a deck of unshuffled cards. Upon dealer command, those cards are transported individually into a randomizing mechanism which comprises a plurality of nests, whereupon each nest is randomly filled with one hand of cards. The microcontroller utilizes a subroutine called a "random number generator" to generate a random target address for selecting one of the eight nests for inserting each card as it is moved from the input portal 90. The microcontroller 84 may generate the random target address on the fly after a prior card has been inserted into a nest. Alternatively, the microcontroller may generate the addresses in advance and temporarily store them as a sequence in its memory. For example, a fifth card out of the input portal might be pre-assigned to a second nest, etc. Both sort addressing methods as are well known in the art.

An indicator on the touchscreen 61 notifies the dealer when the nests are ready for distribution to the players. Thereafter, the dealer commands the shuffler to deliver shuffled (randomized) hands to the discharge portal 70. In one embodiment, the shuffler will automatically deliver a new hand to the discharge portal 70 each time that a previous hand is removed.

Figure 8:
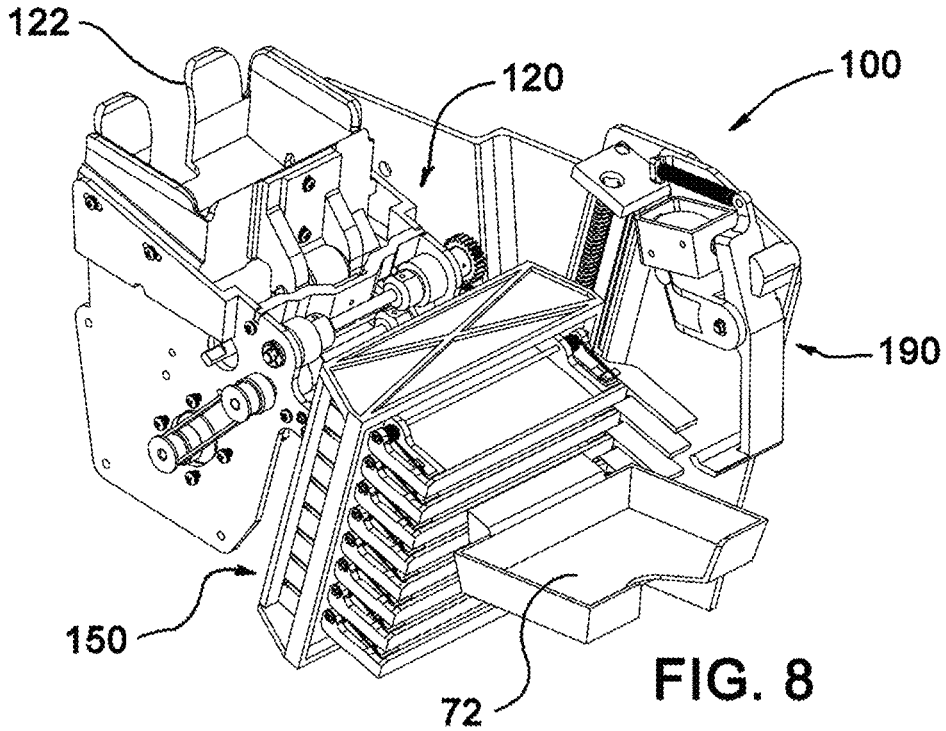
FIG. 8 is a perspective view of the preferred embodiment with its cover housing removed.

An overall view of the low cost shuffler's internal mechanisms is shown in FIG. 8 where the exterior housing and the nearest side frame are not shown in for the purpose of illustration. There are three major subassemblies shown in this figure, including the card transport 120, the elevator 150 and the interposer module 190. Briefly, the card transport 120 moves individual cards from the unshuffled card tray 122 and moves them individually into one of eight randomly selected nests within the elevator 150, which may move along an axis that is skewed from the direction of gravity. When the nests have accumulated a sufficient number of cards to form a hand, the elevator 150 is "shuttled" to discharge the contents of each nest (substack) into the discharge tray 72. The terms "shuttled" and "shuttling" are used herein to describe the incremental and bidirectional movement of the elevator nests. The substacks are discharged to the discharge tray 72 by inertial force after the interposer module 190 relieves the required nest retainer.

Figure 9:
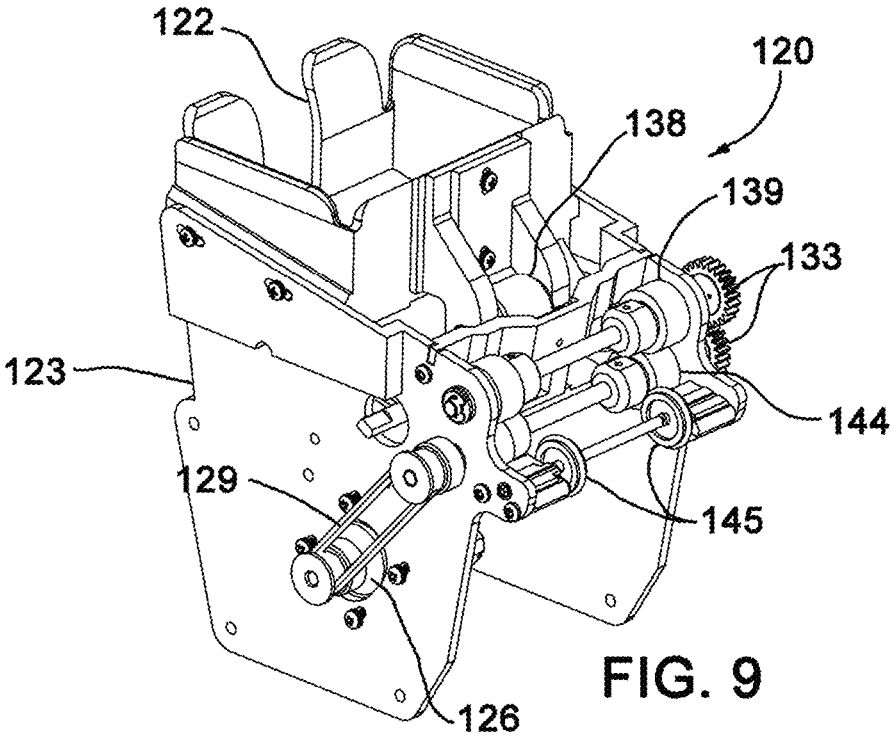
FIG. 9 is a perspective view of the card transport of the preferred embodiment shown with the cover housing of FIG. 7 removed and with even more details removed than in FIG. 8.

An isometric view of the card transport assembly 120 is shown in FIG. 9. Individual card decks are oriented face down in the input tray 122 and moved from the tray 122 and into the elevator 150 by a transport motor 126, rotating a set of stripper rollers via timing belt 129 which removes one card at a time from the unshuffled stack 132. The motor 126, which is a stepper motor, rotates a set of feed rollers via timing belt 130 which accelerates each card into the nests within elevator 150. Two non-powered idler wheels 145 are utilized to rotate each card axis while the card is entered into the entrance orifice of each nest of elevator 150.

Figure 10:
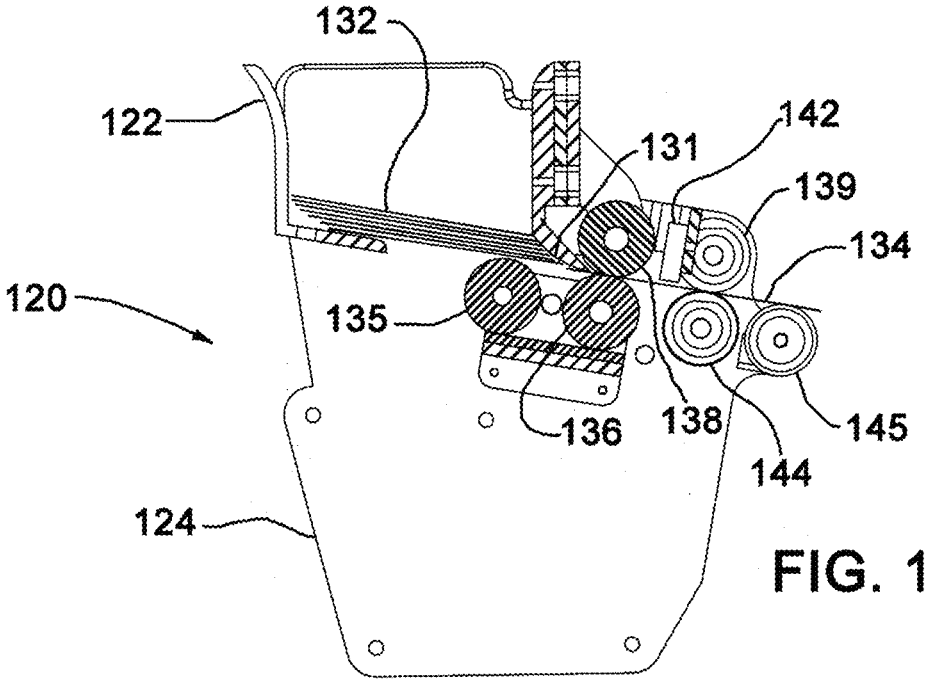
FIG. 10 is a side elevation section view of the card transport of FIG. 9.

FIG. 10 is a section view of the card transport 120 which shows the rubber covered transport rollers which are operated by the motor 126 in response to optical sensor 142. A stack of cards 132 is shown oriented face down in the unshuffled card tray 122 where the stack is partially supported by strip roller 135. The motor 126 rotates the feed rollers 135, 136, 139 and 144 to "strip" individual cards from the bottom of the stack 132 and transports each card until its edge is detected by optical sensor 142. The two feed rollers 139 and 144 define the "exit nip", which is the point where the card becomes released from the driving feed rollers.

The curvilinear configuration of the feed restraining surface 131 is utilized for the purpose of preventing double card feeds. This type of sloped feeder mechanism is known in the copier and printer art as a "bottom feeder" design which has its roots in early 1900's typewriters. The vintage 1932 Mckay '276 patent described above utilized such a sloped bottom feeder design.

The Optical sensor 142 is a reflective light sensor that possesses a high LRV sensitivity, where LRV is an acronym for Light Reflectance Value. LRV is a physical measurement which indicates how much light a color reflects. A sensor with a high LRV sensitivity reflects most of its light source when the target surface is white. In this case, the sensor 142 reflects a high value when it encounters the white border surrounding the pattern on the back surface of a standard playing card. Conversely, the sensor produces a low reflectance value when encountering mixed color images that lie within the white border on playing cards. When the sensor signal is conditioned with a logic circuit, the white border indicates a logic one (high) while the interior pattern indicates a logic zero (low).

Figure 11:
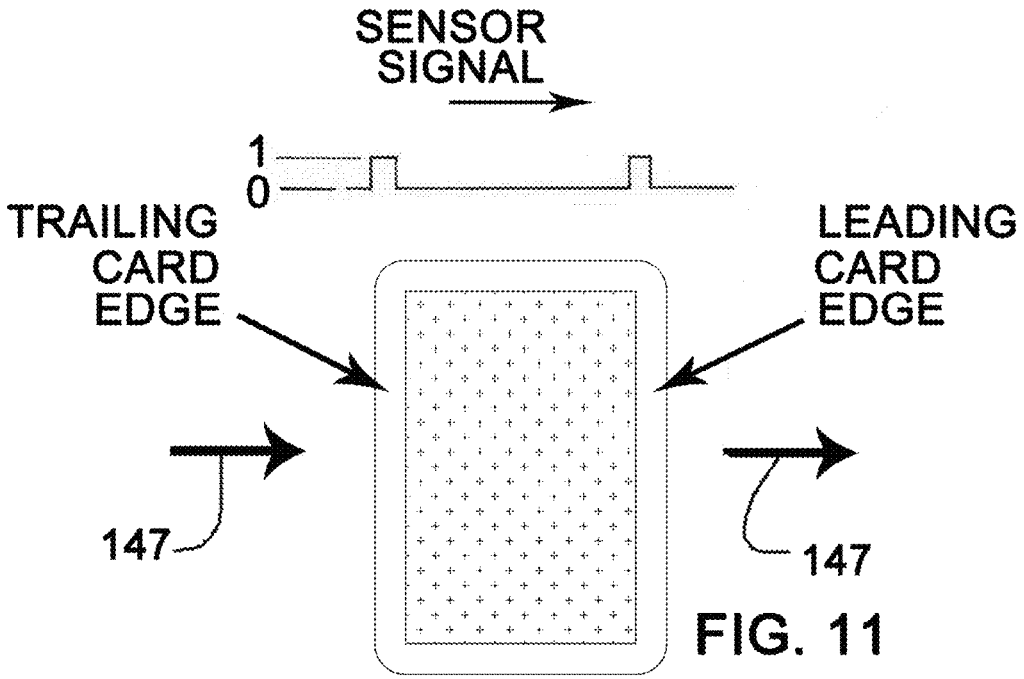
FIG. 11 is an illustration explaining operation of the reflective sensor shown in FIG. 10.

Referring to FIG. 11, the output of the reflective sensor 142 is shown as one card passes below the sensor. The backs of standard playing cards possess a white border which surrounds a decoratively colored interior pattern. By detecting the boundaries of the white border with a sensor that is conditioned to detect white, the transition of logic states can be used to determine the position of each card and also to count the number of cards passing the sensor. In FIG. 11, the logic signal pattern shown above the card indicates the signal to the microcontroller as the card passes in proximity to the sensor 142. The arrows 147 indicate the sensor detection path along the card's surface. A logic level one indicates the leading edge of a card, followed by a transition to a logic level zero and then followed by a transition to a logic level one as the second white border passes the sensor. The logic level falls to zero again as the trailing edge leaves the sensor field of view. In addition to detecting relative card position, the microcontroller 84 utilizes optical sensor 142 to count the cards being inserted into each nest, and also to track the total number of cards passing through the shuffler 100 during one poker game.

Figure 12:
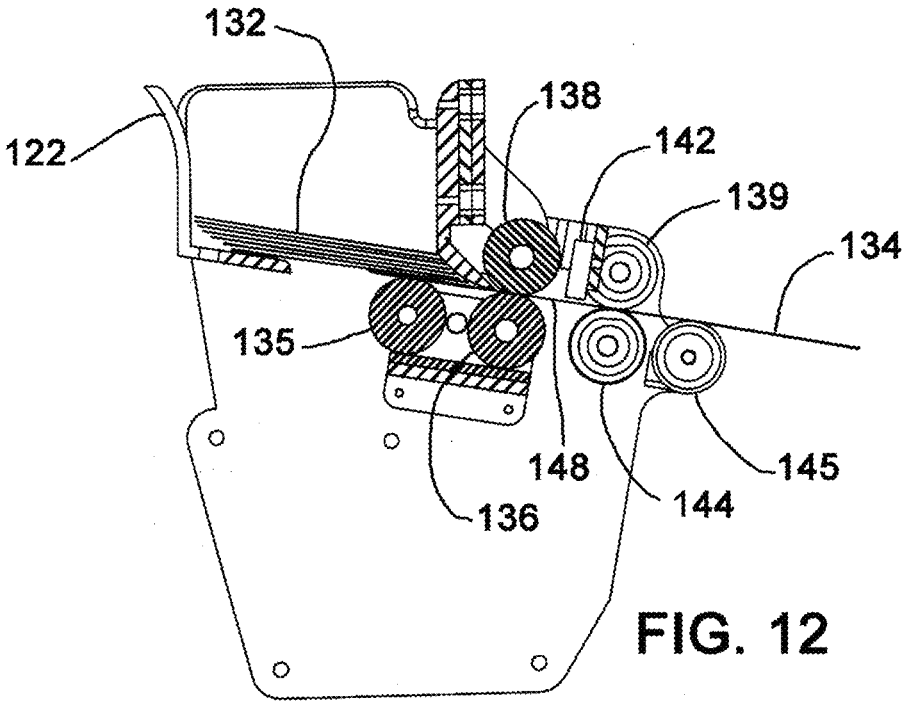
FIG. 12 is a side elevation section view of the card transport of FIG. 9.

When a new deck sort is initiated, the first card out of the input tray 122 is moved until detected by the sensor 142 and then stopped until the elevator 150 has been appropriately shuttled to align the card path with a receiving nest. The pending card is thereafter moved along the card path until the trailing edge is detected by the microcontroller. Once the trailing edge has been identified, the transport motor 126 advances feed rollers 135, 136, 139 and 144 by the equivalent of K motor steps, where K is the number of motor steps needed for the feed rollers to advance the card 134 just past the exit nip formed by feed roller 139 and 144. This condition is shown in FIG. 12 where the card 134 is being supported by the non-powered idler wheels 145 as it is about to leave the nip.

Figure 13A:
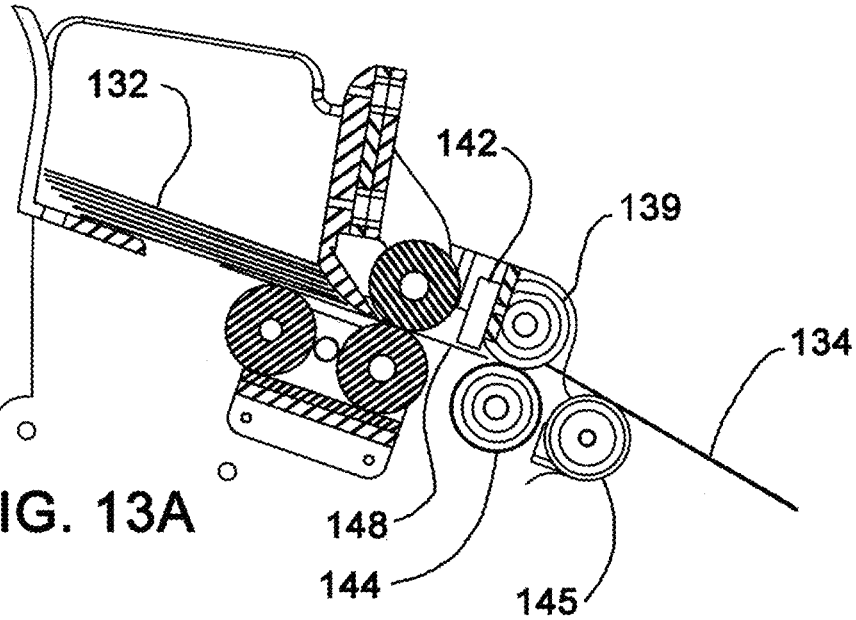
FIGS. 13A and 13B illustrate discharge of a card by the transport shown in FIG. 9.
Figure 13B:
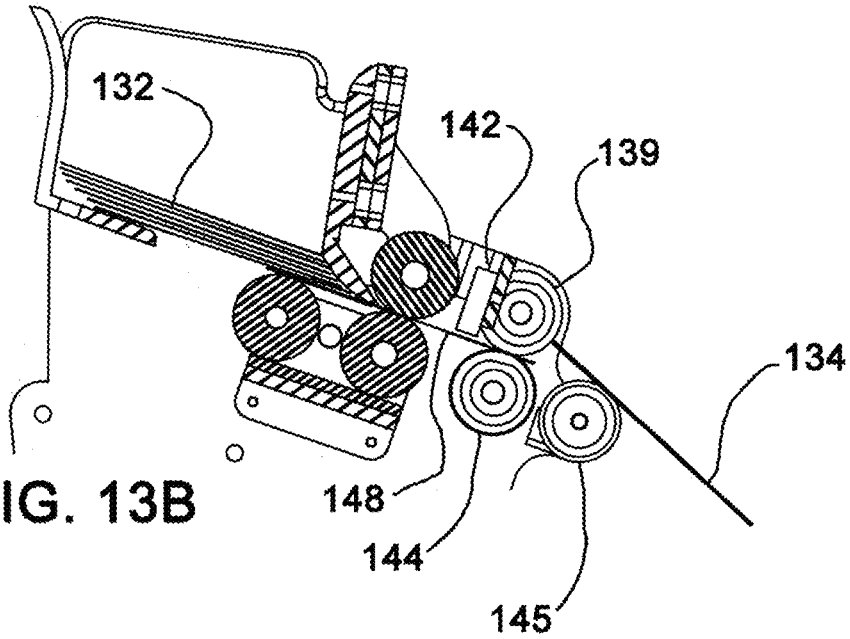
Figure 20:
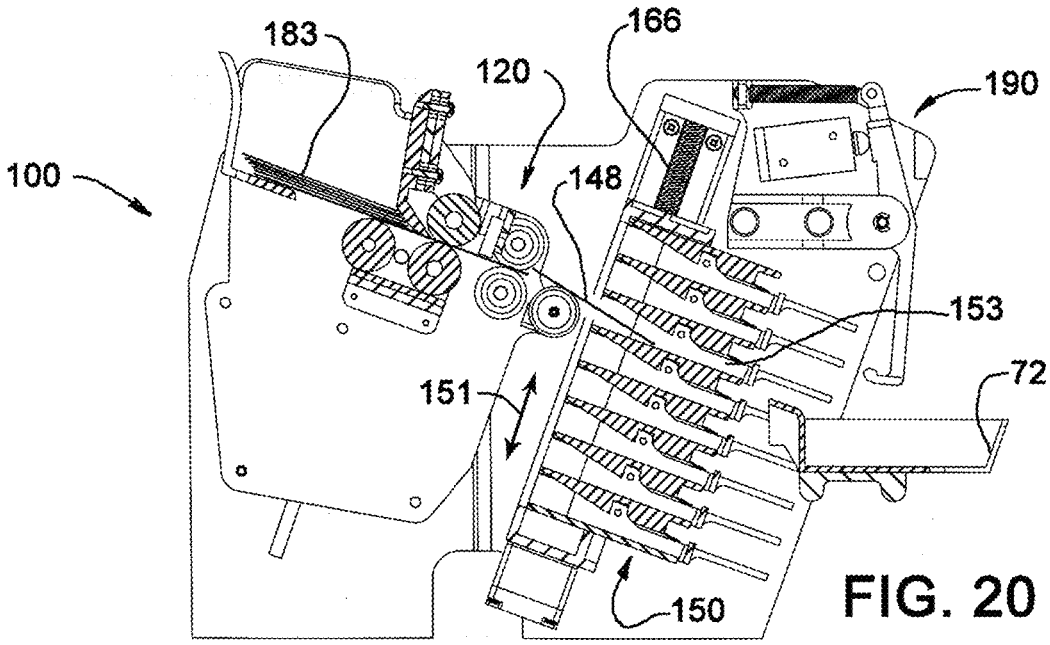
FIG. 20 is a side elevation section view of the low-cost shuffler mechanism.

As each card leaves the exit nip, the idler wheels 145 induce the axis of card 134 to rotate due to gravity while the trailing edge follows the contour of feed roller 139. This progression is depicted in the closer views of the exit nip region as shown in FIGS. 13A and 13B. Note that there exists a small gap between cards with this type of bottom feeder, such that the trailing card 148 has slightly advanced through the nip at the time that card 134 is released. As shown in FIG. 20, each card is partly entered into the upper entrance orifice of the receiving nest as its axis begins to rotate. In this way, the leading edge of each card rotates until it contacts the surface of the upper card in the accumulating substack.

The microcontroller keeps track of the cumulative card count in each nest, and therefore "knows" when that nest is "ready". The definition of a "ready" nest is a nest that has accumulated the correct number of cards that correspond to the size of the hand that is programmed for the game underway. When a nest achieves the "ready" state, the microcontroller no longer directs cards to that nest. After N nests achieve the ready state (N=number required hands), the shuffler 100 will utilize the touchscreen 61 to indicate that the required hands are fully formed within the device and available for discharge upon dealer demand. Alternately, the shuffler 100 may be programmed to automatically deliver the first hand to the discharge tray 72 immediately after any nest achieves the ready state.

Figure 14:
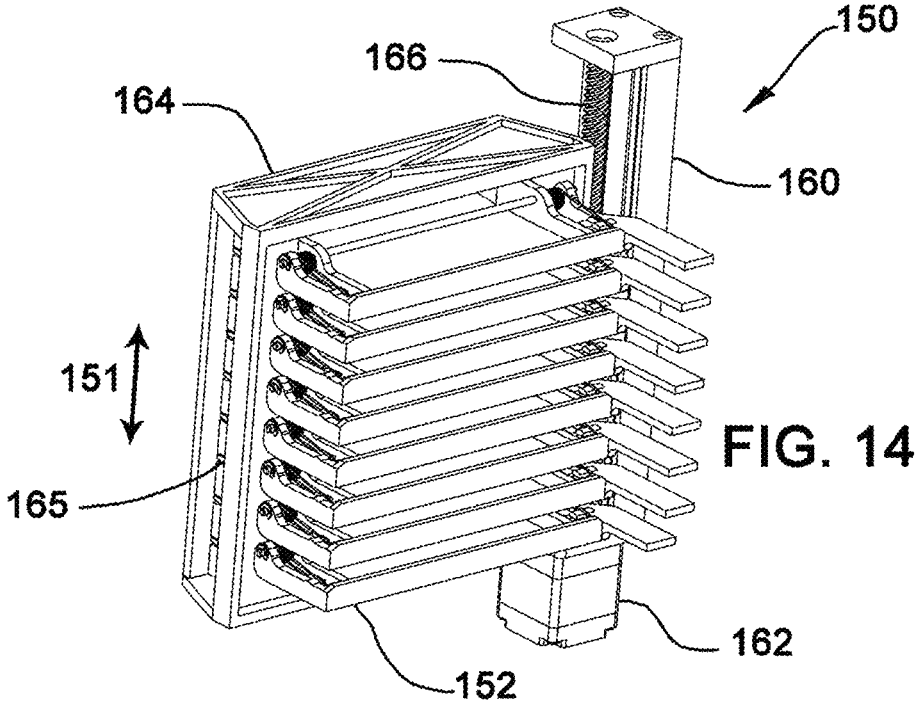
FIG. 14 is a perspective view of the elevator of the preferred embodiment.
Figure 15:
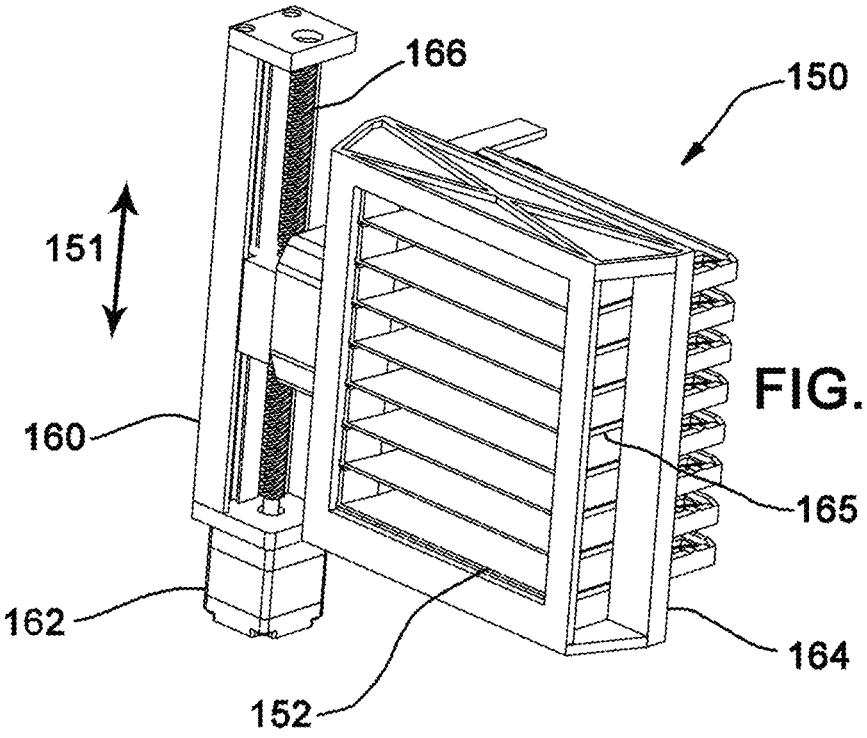
FIG. 15 is a different perspective view of the elevator of the preferred embodiment.

Two isometric views of the elevator 150 are shown in FIG. 14 and FIG. 15 where the assembly is isolated from the overall mechanism shown in FIG. 8. FIG. 14 shows the elevator 150 as viewed from the substack exit direction, while FIG. 15 shows elevator as viewed from the card entry direction. The elevator 150 comprises eight (8) nests 152 which are mounted into the slots 165 of an injection-molded shuttle frame 164. The entire assembly moves bidirectionally along axis 151 as driven by a lead screw mechanism 160, which comprises lead screw 166 which is directly connected to stepper motor 162. The shuttling motion of the elevator is controlled by the microcontroller 84. Considering that an entire deck of cards weighs about three ounces, the microcontroller, stepper motor 162 and lead screw 166 together are capable of shuttling the elevator 150 with linear precision and with significant acceleration while positioning any one of the eight nests into alignment with the card path of the card transport 120. That acceleration imparts reactionary inertial forces upon the substacks residing within the nests.

Figure 16:
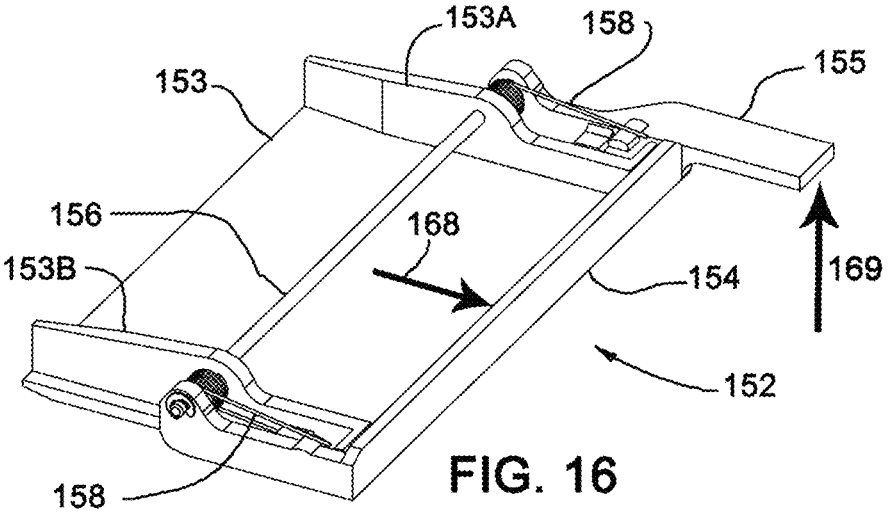
FIG. 16 is a perspective view of one elevator nest of the preferred embodiment.

A single nest 152 is shown isolated in the perspective view of FIG. 16 and comprises a nest base 153 and a movable retainer 154, which are both made of injection molded plastics. The Card substacks are retained within the nests laterally by the walls 153A and 153B. The card substacks are retained along the direction of arrow 168 by the retainer 154, where arrow 168 represents the direction of the substack inertial force. Movement against actuation arm 155 in the direction of arrow 169 induces retainer 154 to pivot about the stainless steel pin 156 which functions as the retainer's axle. Two small torsion springs 158 hold retainer 154 in the position shown in FIG. 16 during the operational procedures utilized for distributing random cards to the nests. The edges of the accumulated card substacks are forced against the internal edge of the retainer 154 in the direction of arrow 168 by inertial force during shuttling motion of the elevator 150. The inertial force acts in a beneficial manner to retain and align the edges of the cards within each substack during the shuttling excursions of the elevator 150.

Figure 17:
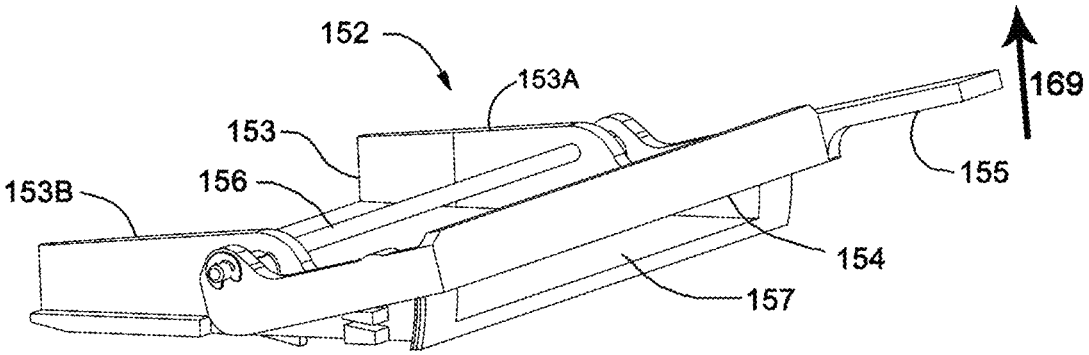
FIG. 17 is another perspective view of the elevator nest of the preferred embodiment.

FIG. 17 illustrates the state where the retainer 154 is pivoted to a displaced position, creating an exit orifice 157 which allows the card substacks to escape from the nest 152. The exit orifice 157 is temporarily created by an actuating force that contacts actuation arm 155 in the direction of arrow 169. Movement of arm 155 pivots the retainer 154 about pin 156 against the restoring action of torsion springs 158, thus creating the exit orifice 157. In comparison to the cost of a stepper motor, the torsion springs, steel pins and injection-molded shutters cost pennies in high volume.

Figure 18:
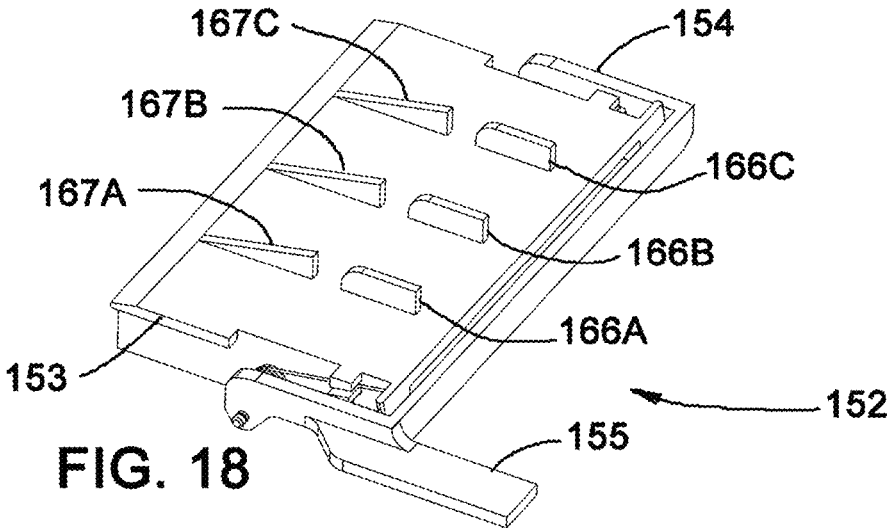
FIG. 18 is a yet another perspective view of the elevator nest of the preferred embodiment.
Figure 19A:
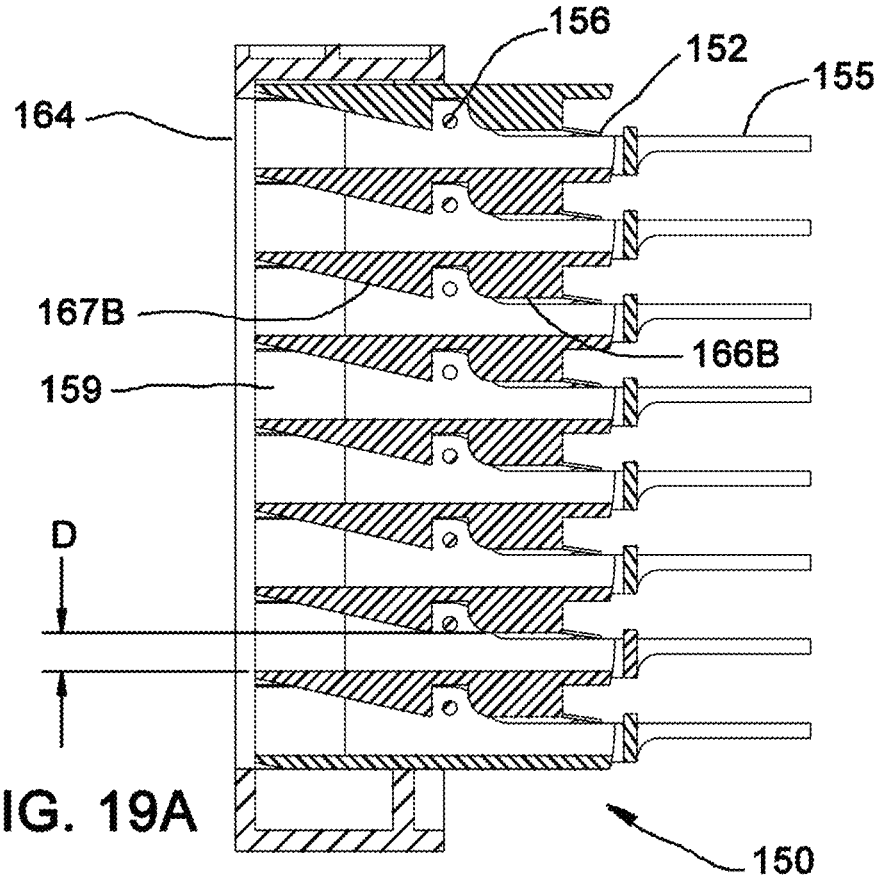
FIG. 19A is a side elevation section view of an elevator assembly.

The underside of the nest base 153 is shown in FIG. 18. This surface of the nest wall 153 possesses three identical angular fins 167A, 167B and 167C which are used to bias the card stacks to the exit orifice of each nest and to prevent collision with the pivot pin 156. Each fin is aligned with a secondary projection 166A, 166B and 166C which are utilized to provide the upper boundary of each nest. FIG. 19A illustrates the positions of the angular fins and aligned projections in a section view of the elevator 150 when the nests 152 have been assembled to the shuttle frame 164.

Figure 19B:
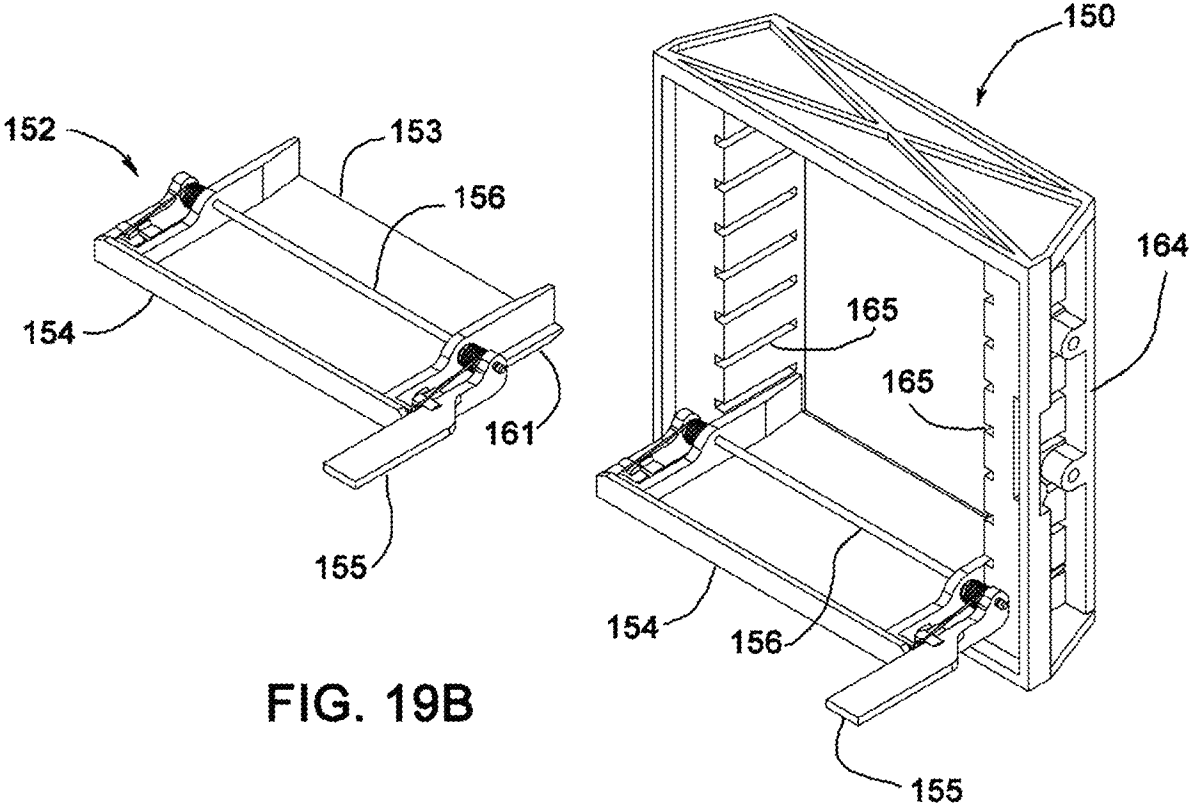
FIG. 19B is an assembly method perspective view.

FIG. 19B is an illustration explaining the manufacturing method for the elevator. Referring to FIG. 19B, an injection-molded frame design 164, having a high strength to weight ratio, possesses a plurality of female slots 165 for receiving the individual nests. Nests 153 possess male projections 161 which mate with the female slots 165. After sub assembly of the pivot pins 156 and retainers 154, each nest is bonded into the appropriate slot 165 to form a rigid elevator housing, which is then attached to the lead screw assembly 160. The bonded assembly is shown in the section view of FIG. 19A.

FIG. 19A shows one or more entrance orifices 159 to the nests 152, which are the sections through the elevator 150 and through the thickness of fins 167B. This view illustrates the internal nest orifices which are each intermittently aligned with the card path of card transport 120 for moving cards individually into the nests 152. The dimension D defines the capacity of the nests in terms of number of cards. Each nest has a capacity of 27 cards which is slightly more than one-half of a card deck. However, the maximum expected hand size is 7 cards in the case of seven card stud poker. The oversize nests guarantee that the card substacks will always be retained loosely within the nests. While the exit orifice 157 (FIG. 17) is sized to allow 27 cards to escape, the entrance orifice of each nest is larger, with an equivalent size of 44 cards. Thus, one characteristic of the preferred embodiment is the distinction that the entrance orifice of each nest is significantly larger than the exit orifice.

A side elevational section view of the preferred embodiment is shown in FIG. 20. The elevator 150 has been shuttled along axis 151 to align a nest (third from top) with the card path of the card transport 120. The leading edge of the card 148 is shown partially entered into the third nest from the top of elevator 150. For clarity of illustration, FIG. 20 shows only one card.

Figure 21:
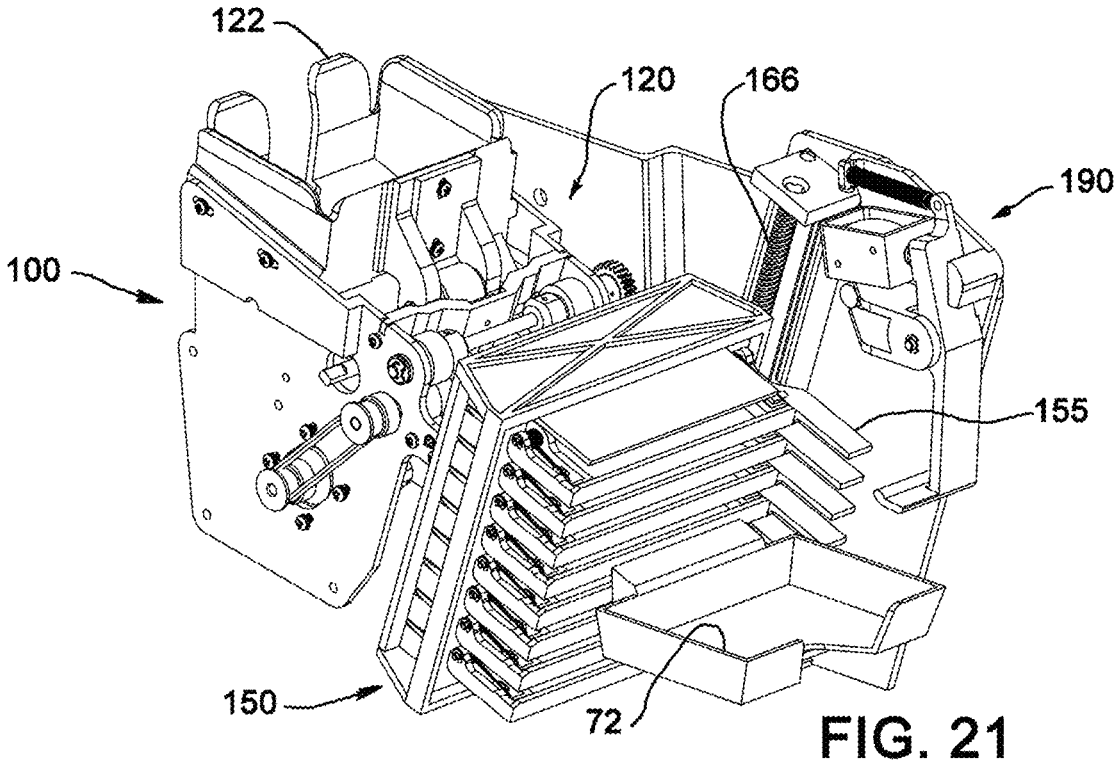
FIG. 21 is a perspective view of the low-cost shuffler mechanism.
Figure 22A:
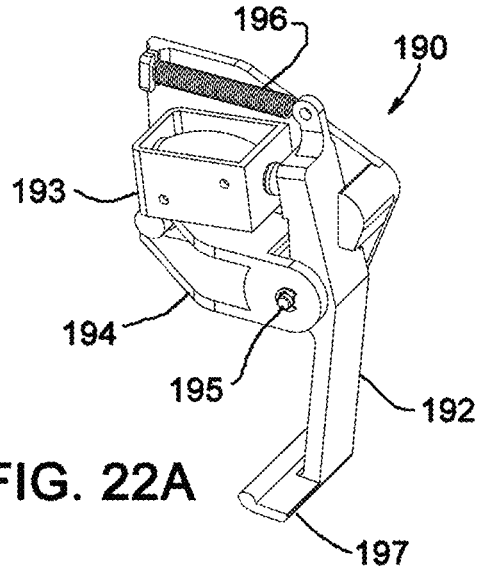
FIG. 22A and FIG. 22B are perspective views of an interposer.
Figure 22B:
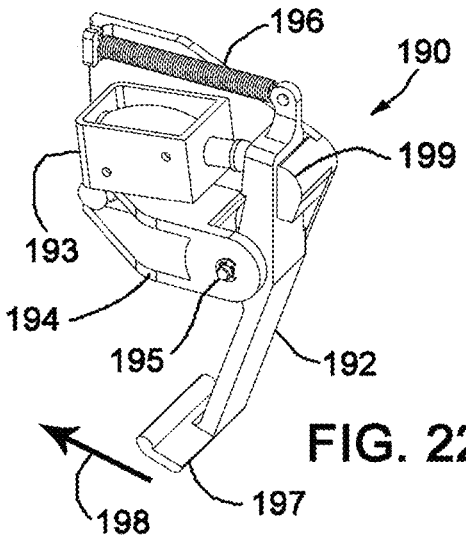

Once the nests accumulate a sufficient number of cards to satisfy the "ready state", inertial force moves the substacks from the individual nests of the elevator 150 to the discharge tray 72 after enabling the interposer module 190. Referring to FIG. 21, the interposer module 190 is mounted laterally from the nests and is shown mounted to the rear side frame. The nest actuation arms 155 and the interposer module 190 operate within a cavity located outside the walls of the discharge tray 72. FIG. 22A and FIG. 22B explain the operation of the interposer module 190.

Referring to FIG. 22A, the interposer module 190 is shown in isolation. The module consists of an interposer arm 192, a pivot pin 195, an open frame solenoid 193, a return spring 196 and an injection molded mounting plate 194. The open frame solenoid is chosen as the actuator because of its economy, having a cost about ⅓rd that of a stepper motor. The interposer 192 is an injection molded component which possesses an actuation finger 197 at its lower extremity. The solenoid is not activated in FIG. 22A and the return spring 196 is holding the interposer arm 192 in the position shown, which is called the interposer rest position. In FIG. 22B, the solenoid 193 has been actuated by a voltage pulse which causes the interposer arm 192 to rotate clockwise about pin 195, moving the interposer finger 197 in the direction of arrow 198. Rotation of the interposer is stopped by projection 199 which is an integral part of the mounting plate 194. The state depicted in FIG. 22B is called an interposer actuated position.

The interposer arm 192 is used to enable the movement of any of the movable retainers 154 by intercepting the path of any of the eight actuation arms 155. Referring to FIG. 20, the interposer arm 192 is shown in its rest position where it is unable engage the path of the arms 155.

Figure 23:
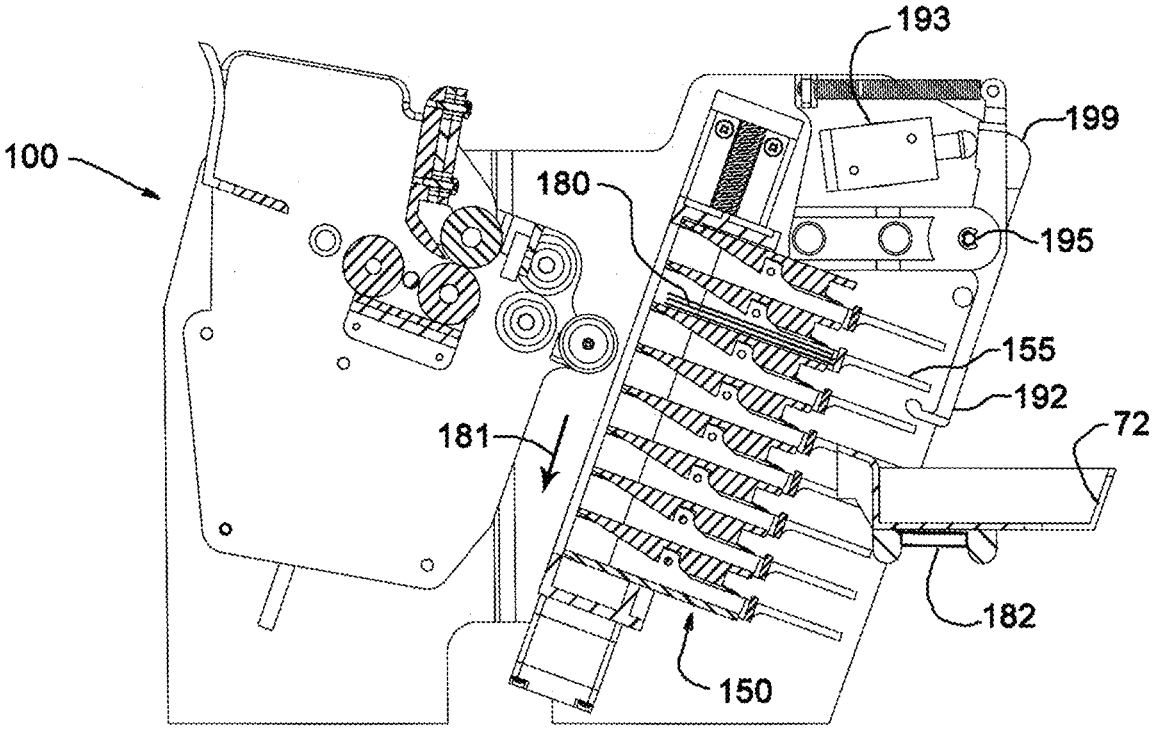
FIG. 23 is a side elevation section view of the preferred embodiment.

Referring to FIG. 23, the interposer is shown in the actuated position and the elevator 150 has been shuttled to a "pre-launch" position prior to launching substack 180 into discharge tray 72. The Discharge tray 72 possesses an optical sensor 182 in its base which is used to detect the presence of cards. If no cards are present, the shuffler 100 is ready to launch the substack 180. The elevator 150 has been momentarily paused while the interposer finger 197 is injected into the path of the second nest from the top and is in a position to intercept arm 155 of that nest when the elevator moves in the direction of arrow 181. FIG. 23 thus illustrates the "pre-launch" state of the shuffler 100 when it is about to move the card substack 180 into discharge tray 72.

Figure 24:
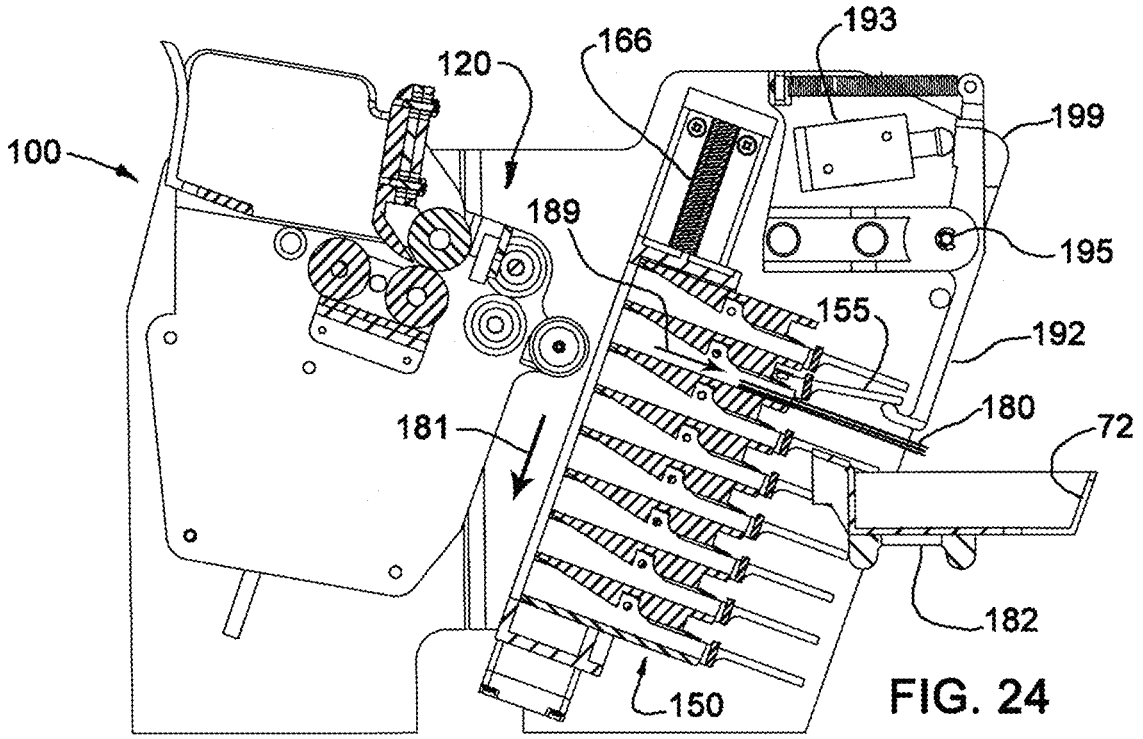
FIG. 24 is a side elevation section view of the preferred embodiment while discharging hands.

While the interposer 192 is held in this actuated position (FIG. 23), the elevator 150 is thereafter rapidly moved in the direction of arrow 181 and rapidly stopped at the card delivery position as shown in FIG. 24. The deceleration causes inertial force to rapidly discharge the substack 180 into the discharge tray 72 while the moveable retainer arm 155 is restrained. Arrow 189 indicates the direction of the inertial force as the elevator 150 reaches its terminal discharge destination. After a momentary pause, the elevator 150 is returned to the "pre-launch" position and the solenoid 193 is deenergized, allowing the interposer spring 196 to extract the interposer finger 197 from the path of actuator arms 155. The shuffler 100 is then ready to move a shuffled (randomized) substack from another nest 152 to the discharge tray 72.

In comparison to the prior art, the movement of the substack during discharge is slightly more than the equivalent of one card width in the preferred embodiment. The discharge movement of the pusher devices in the prior art is substantially longer, thus requiring more time. In addition, the pusher mechanisms need a retraction stroke to restore the pusher which doubles the time for pusher movement. In this way, the preferred embodiment can discharge the substacks to the output tray more rapidly than the cited prior art.

Once delivered to the discharge tray 72, the shuffler randomly positions another nest of the elevator 150 to the "pre-launch" position and actuates the interposer 192. If the sensor 182 indicates that the discharge tray 72 is empty, then the next launch cycle can be initiated. In one programmable operating mode, the next cycle is initiated by the dealer via the touchscreen 61. In an alternate programmable operating mode, the shuffler automatically disgorges the next hand when the sensor 182 indicates that the dealer has removed a hand. The discharge cycle is repeated until all of the required hands are delivered to discharge tray 72.

In an alternate embodiment, the elevator 150 may be moved slowly to a state wherein the card substacks are moved to the discharge tray 72 solely by gravity, rather than by inertial force. In this alternate embodiment, the elevator moves slowly to discharge each nest substack after the interposer 192 has intercepted the movable retainer 154. As the elevator 150 approaches the aligned position, the card substack thereafter slides into the discharge tray 72 by gravity.

After the hands have been distributed to all players, there are various amounts of cards left in the nests and in the unshuffled card portal. For example, for certain 7-card stud games such as "Rollover" or "Baseball", each hand consists of seven cards which are delivered to each player, and no additional cards are needed for that game. If there are five players, then thirty-five (35) cards will have been dealt, leaving seventeen (17) cards within the shuffler. Some of these residual cards will have been delivered to unfilled nests and some will remain within the unshuffled card tray 122. Comparatively, a game of Three-Card Poker® with five players will only utilize eighteen (18) cards (five player hands and one dealer hand). In this latter case, the majority of cards will remain unplayed and the dealer will purge the shuffler of these residual cards before starting a new game. This process is called a purging cycle.

While forming hands, the microcontroller tracks the number of cards moving into and out of each nest, and "knows" how many residual cards remain in each nest, if any, at the end of each poker game. Within the purging cycle, the microcontroller rotates each non-empty nest appropriately to unload the residual substacks into the discharge tray 72. However, the microcontroller does not "know" the number of cards remaining in the unshuffled card portal.

The shuffler 100 provides options in regard to purging those cards remaining in the unshuffled card portal. In one embodiment, the dealer may program the shuffler 100 to sort the cards remaining in the unshuffled card portal into the nests, and thereafter deliver them to the discharge tray 72. In another embodiment, the dealer may program the shuffler to rapidly deliver the unshuffled cards directly from the unshuffled card portal to the shuffled card portal.

Figure 25:
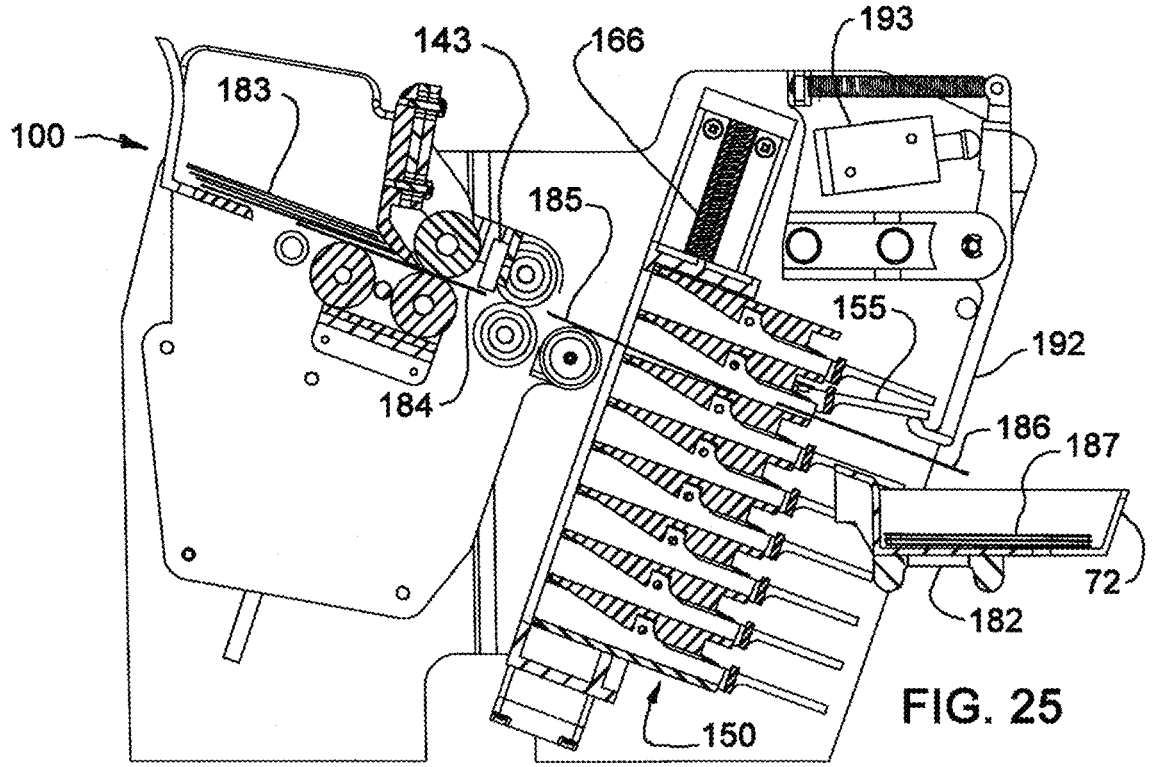
FIG. 25 is a side elevation section view of the preferred embodiment while discharging individual cards.

This latter option is accomplished by aligning any nest within the elevator 150 with the path of the card transport as shown in FIG. 25, such that individual cards may be rapidly moved to the discharge tray 72 without requiring movement of the elevator 150. Referring to FIG. 25, individual cards 184, 185, and 186 are being rapidly moved from the unshuffled stack 183 to the stack 187 in the discharge tray 72. An optical sensor (not shown) located in the floor of the unshuffled card portal alerts the microcontroller when no cards remain is stack 183, and the optical sensor 143 will have finished its card count when the unshuffled card portal is empty.

At the termination of the purging cycle, the microcontroller will display the card count on the touchscreen 61. If the count is unexpected, for example from cheating by a player or dealer, then an error message and warning will be signaled such as by a flashing visual indicator or audible warning. In this way, the deck size may be properly validated before utilization in a successive game.

Figure 26:
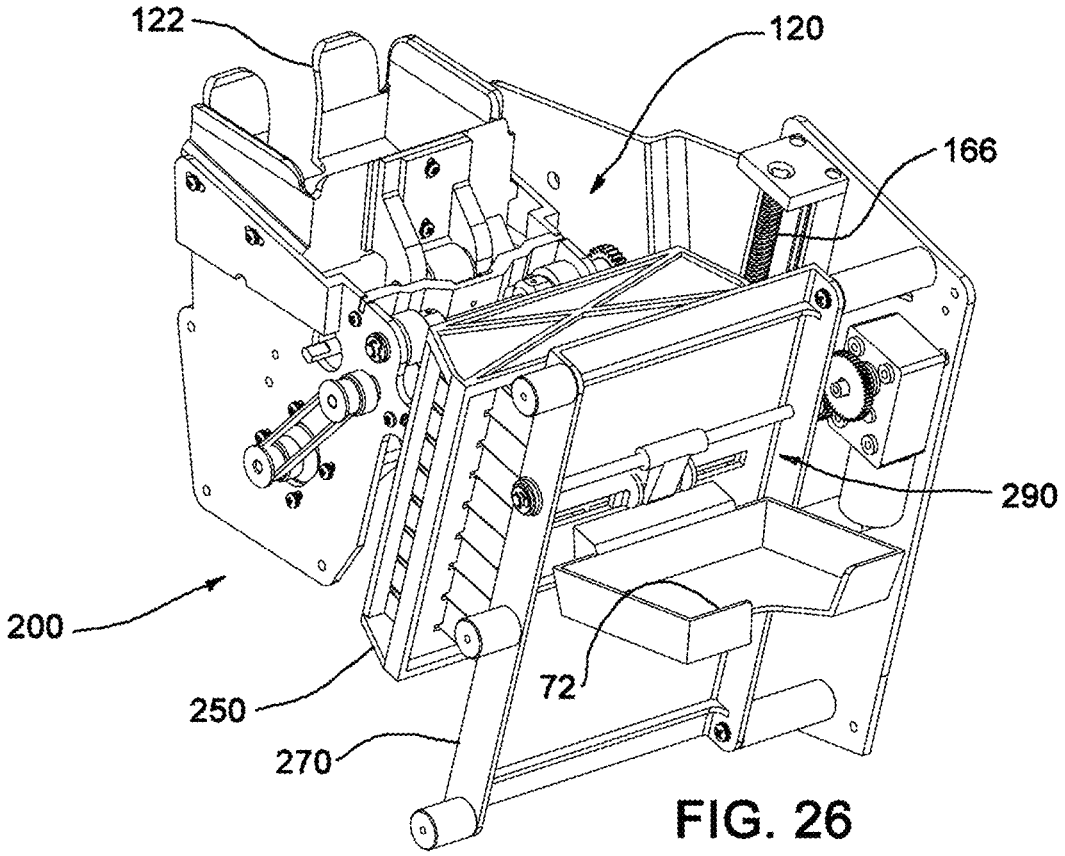
FIG. 26 is a perspective view of the second embodiment of the low-cost shuffler.

A second embodiment of the low-cost shuffler utilizes a stationary retainer and a single moveable shutter to facilitate the inertial launch of substacks into the discharge tray 72. FIG. 26 illustrates a perspective view of the shuffler 200 with elevator 250, stationary retainer 270 and moveable shutter assembly 290. The card transport 120 and the discharge tray 72 are the same components as utilized in the preferred embodiment. The outer casing and nearest side frame have been removed in this figure in order to reveal the interior components.

Figure 27A:
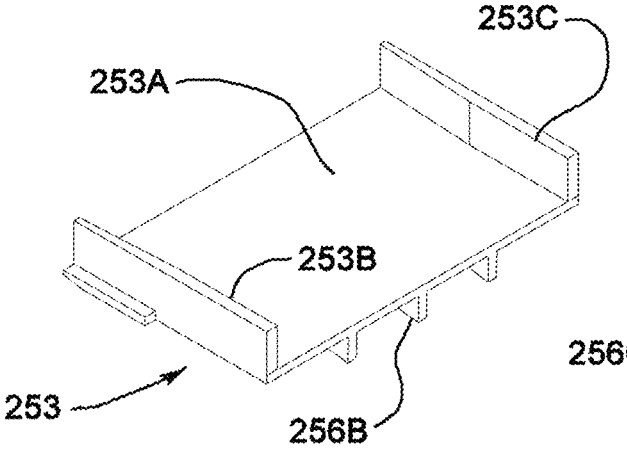
FIG. 27A and FIG. 27B are different perspective views of the nest configuration of the second embodiment.
Figure 27B:
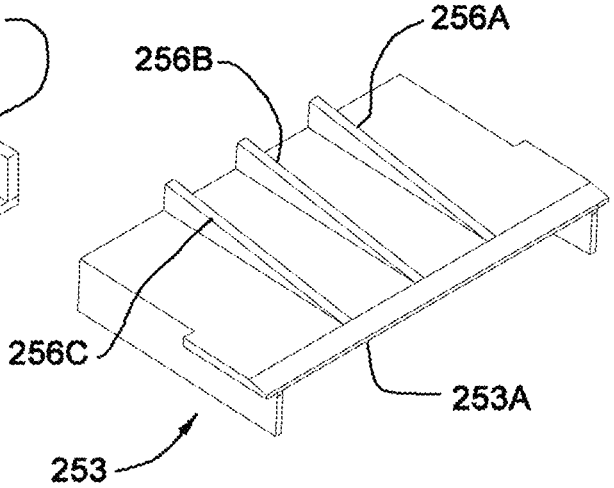

The elevator 250 in this embodiment is similar to the elevator 150 in the preferred embodiment and shuttles along the same axis by the same lead screw 166. However, in this embodiment the nests in the elevator 250 are designed differently than in the preferred embodiment. FIG. 27A and FIG. 27B show two views of a single injection molded nest 253. The card substacks are laterally contained by walls 253B and 253C, while the cards are supported face down upon surface 253A in FIG. 27A. The opposite side of the nest wall from surface 253A possesses three identical angular fins 256A, 256B and 256C which are used to bias the card stacks towards the exit orifice of each nest, as shown in the section view of FIG. 28.

Figure 28:
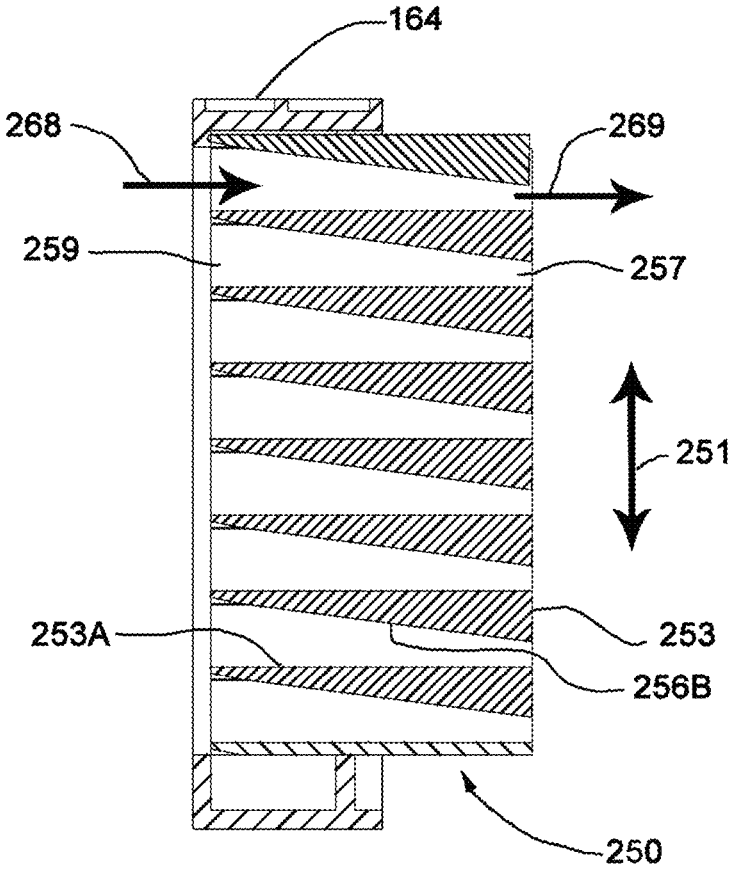
FIG. 28 is a side elevation section view of the elevator of the second embodiment.

A side elevation section view of the elevator 250 is shown in FIG. 28, which illustrates the tapered shape of each nest whereupon the exit orifice is smaller than the entrance orifice. This section view is taken in a plane that is parallel to the fins 256 and is perpendicular to the elevator axis 251. The section is taken through the center of the elevator 250 which corresponds with the center of fin 256B. Elevator frame 164 supports the nests 253 and is identical to the injection molded frame of the first embodiment as shown in FIG. 14 and FIG. 15. The entrance orifice 259 to each nest is sized equivalently to the thickness of thirty-six (36) playing cards, while the exit orifice 257 is sized equivalently to the approximate thickness of twenty (20) playing cards. Since the maximum substack size is seven cards (7 card stud hand), the oversized nest capacity guarantees that the substacks will be loosely retained in each nest. The arrow 268 and arrow 269 indicate the direction that the cards enter and exit each nest. Both the entrance and exit directions are in the same direction as the inertial force imposed upon the substacks by the elevator motion.

Figure 29:
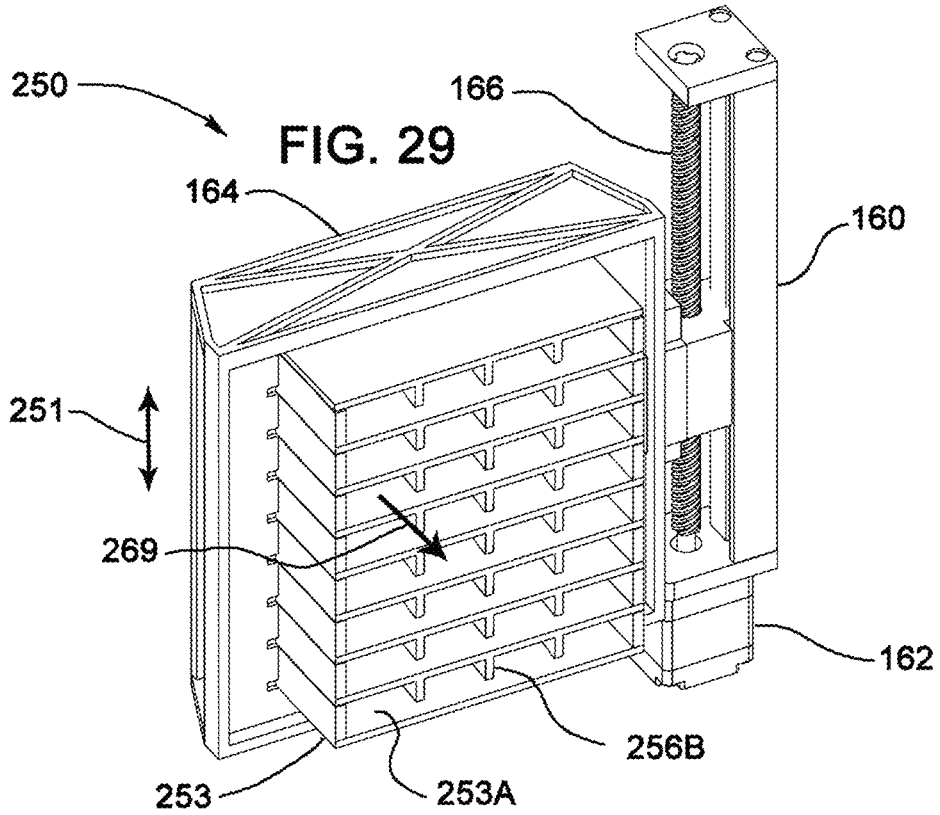
FIG. 29 is a perspective view of the elevator of the second embodiment.
Figure 30:
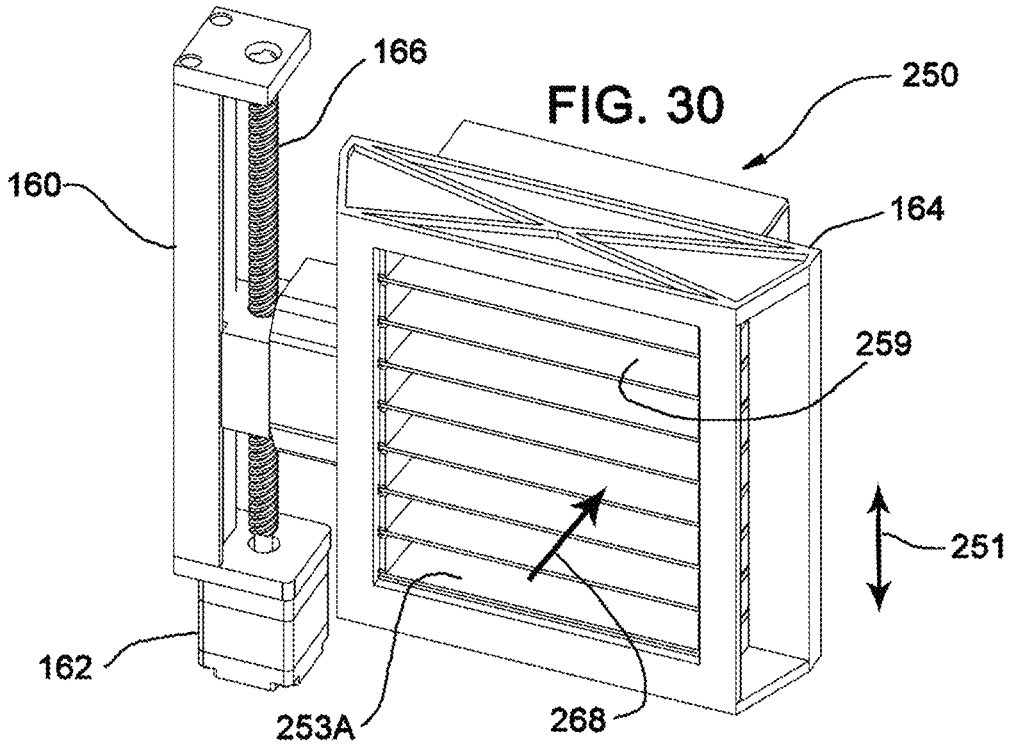
FIG. 30 is a different perspective view of the elevator of the second embodiment.

FIG. 29 and FIG. 30 show perspective views of the elevator assembly 250, where FIG. 29 shows the substack exit side of the elevator as indicated by the substack exit arrow 269. FIG. 30 illustrates the plurality of nest entry orifices 259 which are adjacent to the card transport 220. Arrow 268 indicates the entry direction of the individual cards.

Figure 31:
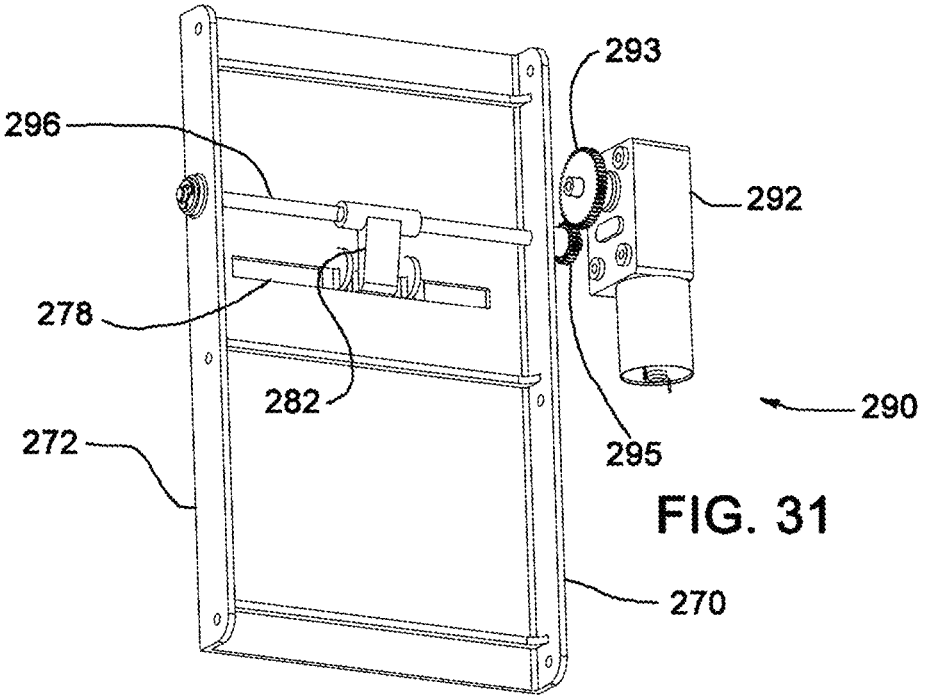
FIG. 31 is a perspective view of the shutter mechanism of the second embodiment.
Figure 32:
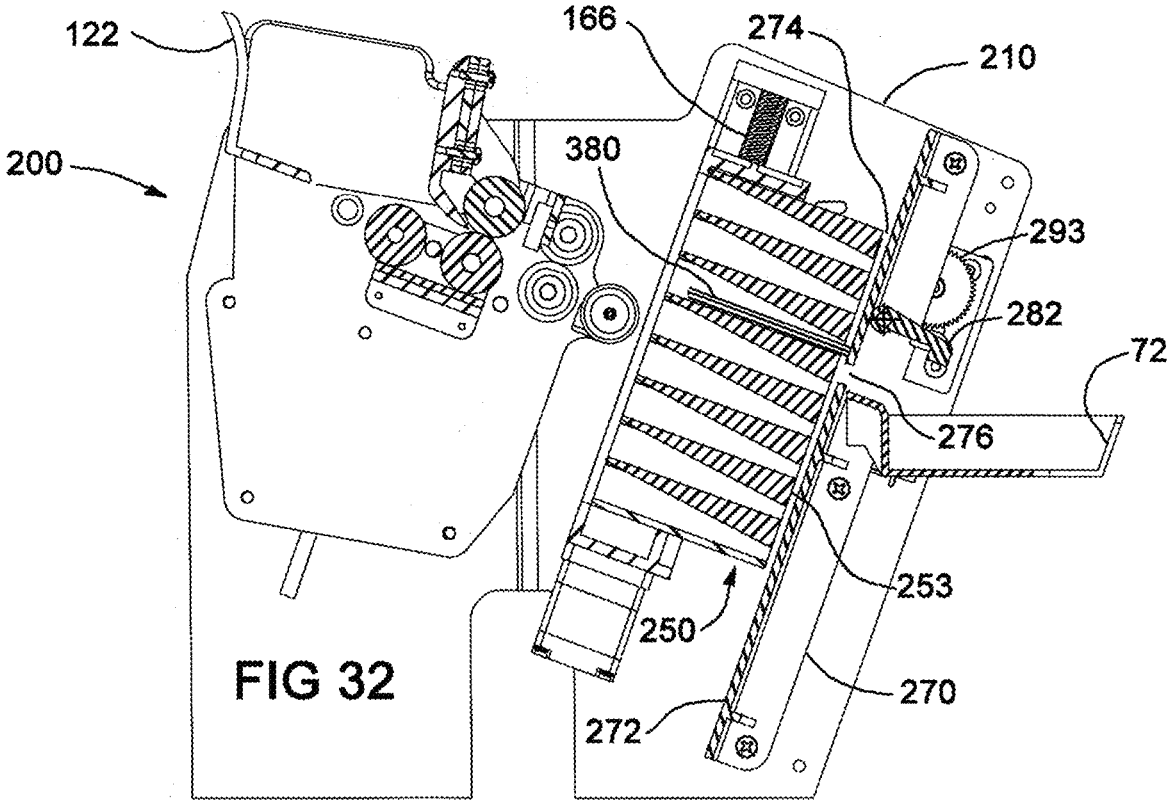
FIG. 32 is a section view showing the second embodiment in its "pre-launch" state.

FIG. 31 shows a view of the shutter mechanism 290 and its relationship to the flat-faced retainer 270. The retainer has an internal flat surface 272 which is aligned with the motion of the elevator 250. Referring to FIG. 32, a gap 274 exists between the extremities of the elevator 250 and the internal retainer surface 272, which allows the card substacks to protrude slightly from the nests 253 and bear upon the surface 272. During shuttling of the elevator 250, inertial forces induce the edges of the cards to contact surface 272 of the retainer 270, thus aligning the edges of each card in the each substack.

Cards are moved by inertial force from the nests 253 to the discharge tray 72 through a slit 278 in the retainer 270. A rotating shutter 282 is normally located within the slit 278 as shown in FIG. 31. The interior surface of the shutter is flush with the interior surface 272 of the retainer 270 when in the normal position of closing off the slit. The slit 278 is sized slightly larger than the exit orifice 257 of the nest 253 both in width and length.

Referring to FIG. 31, the rotating shutter is operated by a DC motor/gearbox actuator 292 which is mounted to the far side frame 210. A gear 293 on the actuator shaft of the DC motor/gearbox rotates pinon 295 on the end of shaft 296. Both the shutter 282 and the pinion 295 are rigidly attached to the shaft 296, such that the shutter 282 and the pinion 295 rotate synchronously. A small trickle current applied to the DC motor is used to hold the shutter 282 in a closed state. Rotation of the gear 293 clockwise causes the shutter 282 to rotate counterclockwise, thus allowing a properly positioned card substack to escape through the slit 278.

This embodiment has a "pre-launch" state in a similar manner as was described in the preferred embodiment. Referring to FIG. 32, the shutter 282 is shown in the actuated position and the elevator 250 has been moved to a "pre-launch" position prior to launching substack 380 into discharge tray 72. The edges of substack 380 are resting against the surface 272 of retainer 270. Discharge tray 72 possesses an optical sensor 182 (not shown) in its base which is used to detect the presence of cards. If no cards are present, the shuffler 200 is ready to launch the substack 380. In FIG. 32, the elevator 250 has been momentarily stopped while the shutter 282 was moved to the actuated position. For clarity, only one substack 380 is shown in the elevator 250. A closer view of the "pre-launch" position is shown in FIG. 33.

Figure 33:
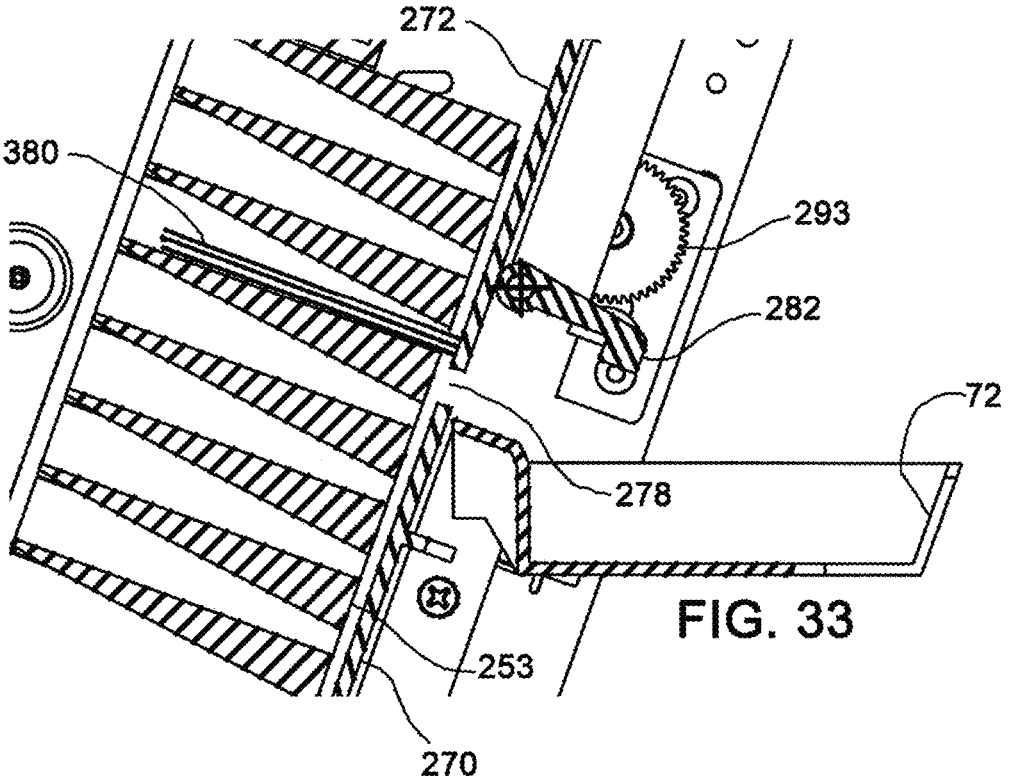
FIG. 33 is another section view of the second embodiment in its "pre-launch" state.
Figure 34:
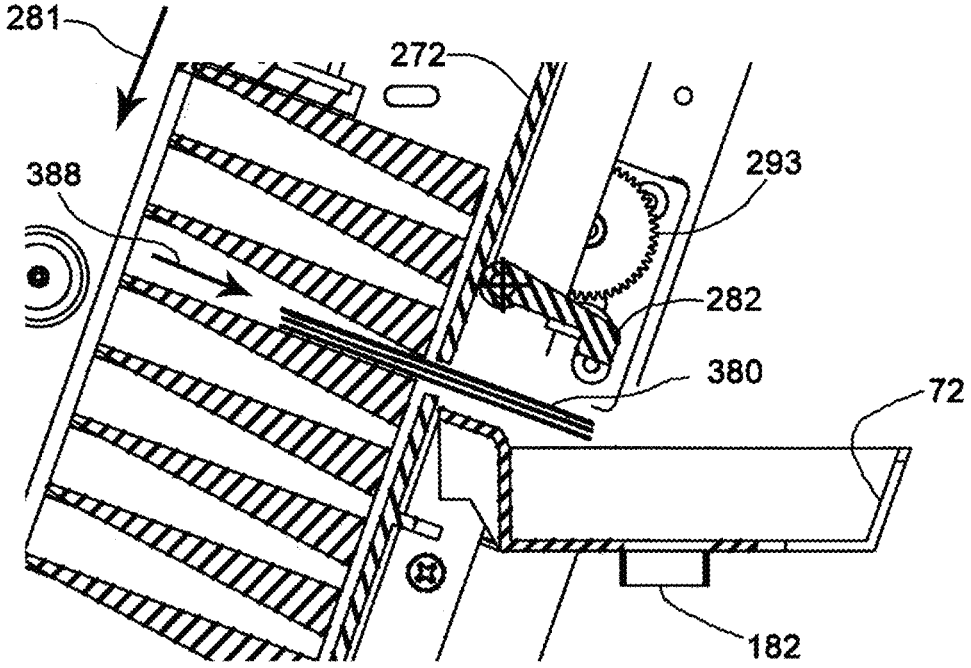
FIG. 34 is a section view of the second embodiment showing a card substack being launched into an output tray.

FIG. 33 and FIG. 34 together illustrate the inertial discharge of the substack 380 from its nest in the elevator 250. FIG. 33 shows the "pre-launch" condition as described above in FIG. 32. While shutter 282 is held in this actuated position, the elevator 250 is thereafter rapidly moved in direction of arrow 281 and rapidly stopped at the discharge delivery position as shown in FIG. 34. The rapid deceleration causes inertial force to discharge the substack 380 into the discharge tray 72 while the shutter 282 remains actuated.

The Arrow 388 indicates the direction of the inertial force as the elevator 250 reaches its terminal discharge destination. After a momentary pause, the elevator 250 is returned a short distance to the "pre-launch" position and the shutter 282 is returned to the closed position as shown in FIG. 31. The shuffler 200 is thereafter ready to move a shuffled (randomized) substack from another nest 253 to the discharge tray 72.

Once a substack has been delivered to the discharge tray 72, the shuffler 200 randomly positions another nest of the elevator 250 to its "pre-launch" position and actuates the shutter 282. If the output tray sensor 182 indicates that the discharge tray 72 is empty, then the next launch cycle can be initiated. In one programmable operating mode, the next cycle is initiated by the dealer via the touchscreen 61. In an alternate programmable operating mode, the shuffler automatically disgorges the next hand when the sensor 182 indicates that the dealer has removed the previous hand. The discharge cycle is repeated until all of the required hands are delivered to discharge tray 72.

In an alternate embodiment, the elevator 250 may be more slowly moved to a state wherein the card substacks are moved to the discharge tray 72 by gravity, rather than by inertial force. In that alternate embodiment, the elevator 250 shuttles to directly align each nest substack with the slit 278. The shutter 282 is thereafter rotated to the actuated position, allowing the substacks to slide by gravity into the discharge tray 72.

Figure 35:
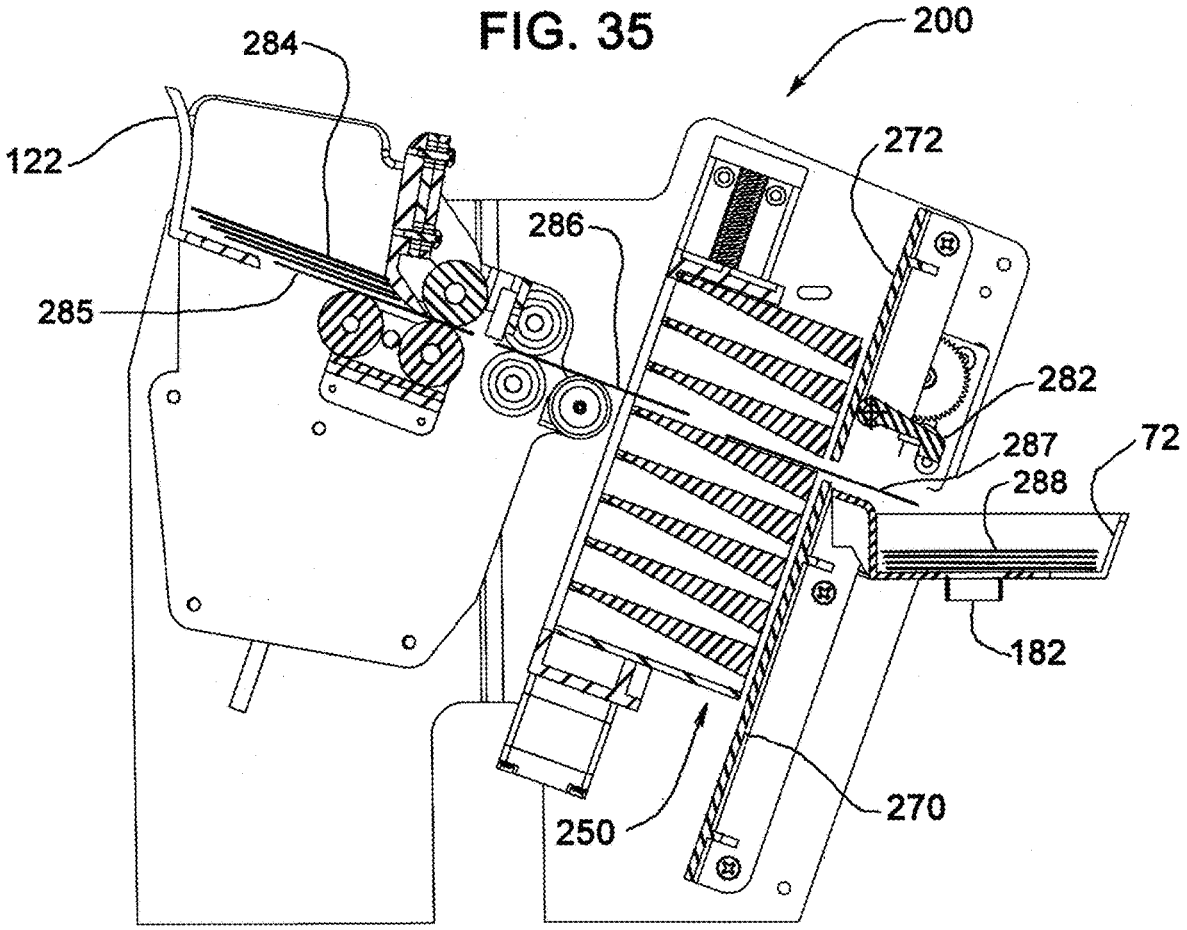
FIG. 35 is a section view of the second embodiment showing individual cards being purged from an input portal.

The purging cycle for the second embodiment is the same as described above for the preferred embodiment. The elevator 250 may be positioned by the microcontroller to provide a direct straight-line path for rapidly moving cards from the unshuffled card portal to the discharge tray 72. During this portion of the purging cycle, any nest 253 can be aligned with both the card path and the slit 278 while the shutter 282 is held in the actuated position as shown in FIG. 35. Referring to FIG. 35, individual cards 285, 286, and 287 are being rapidly moved directly along a straight-line path from the residual unshuffled card stack 284 to the card stack shown as 288 in the discharge tray 72, without requiring any movement of the elevator 250. As with the preferred embodiment, the purging cycle of the shuffler 200 is utilized by the microcontroller to validate the deck count.

Figure 36:
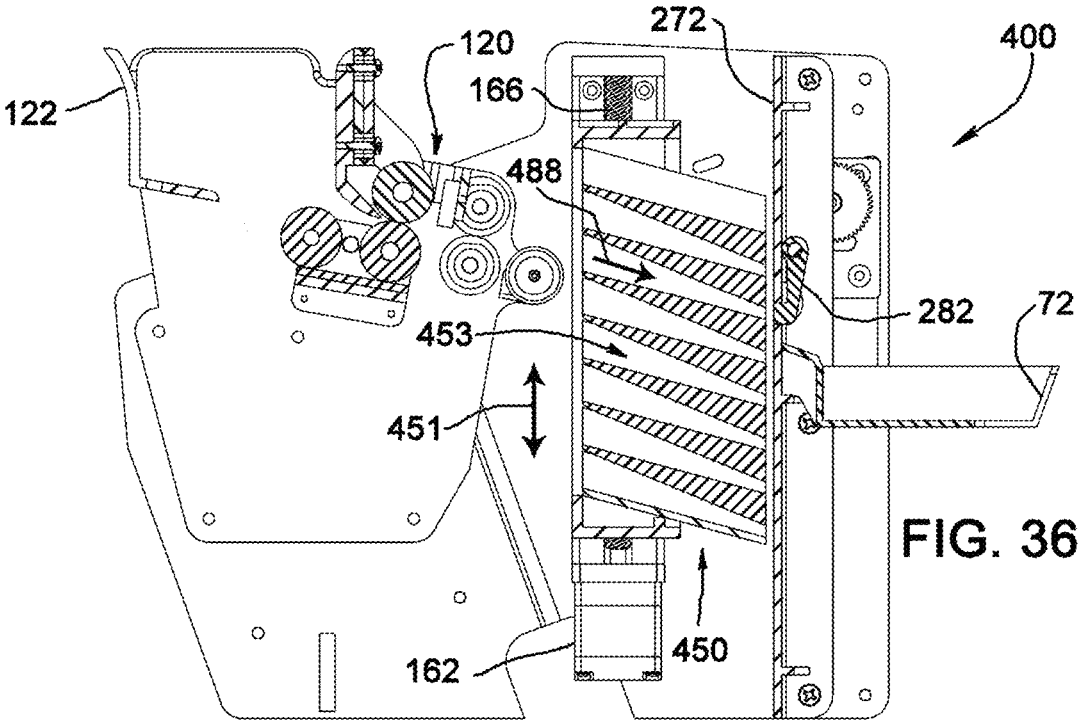
FIG. 36 is a section view illustrating the third embodiment of the low-cost shuffler.

Other embodiments may utilize elevator geometry that is different than the elevators of the previously described embodiments. In a third embodiment shown in FIG. 36, the elevator axis is not skewed from the axis of gravity, but is aligned with the axis of gravity. Shuffler 400 utilizes the same card transport 120 as the previous embodiments and adopts an elevator assembly 450 whose axis is aligned with gravity as shown by arrow 451. The elevator is powered by the same lead screw 166 and stepper motor 162 as was explained in the earlier embodiments (see FIG. 15). The card storage nests 453 in elevator 450 are however articulated at an angle that is sloped from the axis of gravity. Arrow 488 indicates the direction of inertia force that expels the substacks from the nests 453. This elevator configuration is shown with the stationary retainer 270 and shutter 282 from the second embodiment, but this elevator configuration is also adaptable for use with the interposer module 190 of the preferred embodiment (see FIG. 22A).

Figure 37:
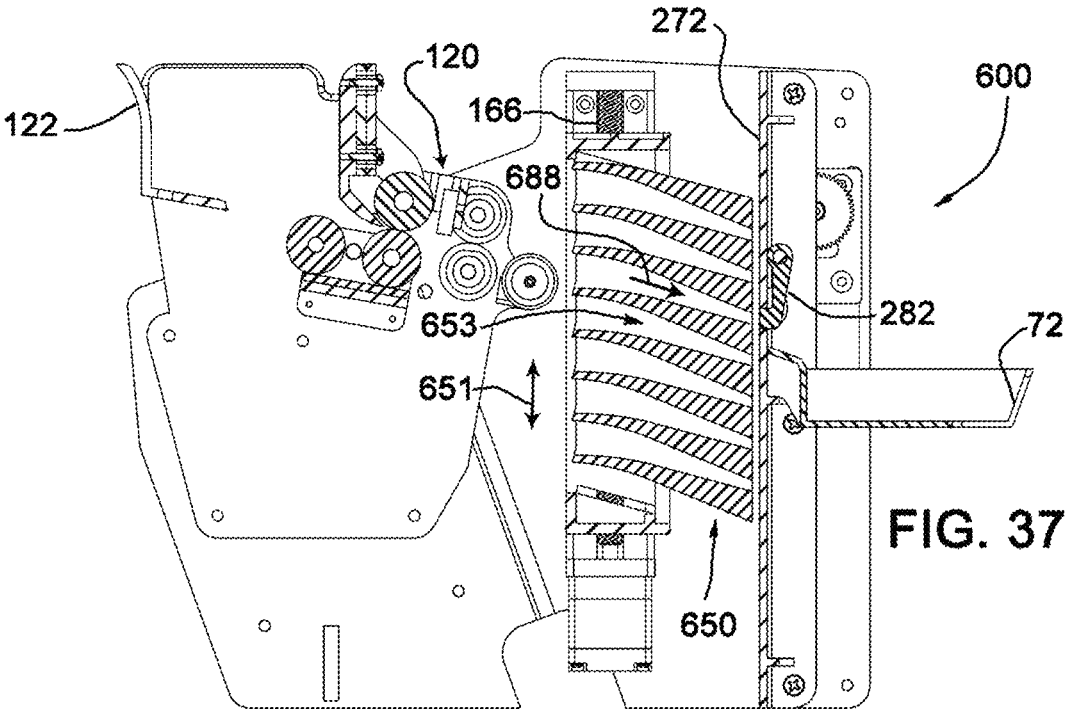
FIG. 37 is a section view illustrating the fourth embodiment of the low-cost shuffler.

A fourth embodiment is illustrated in FIG. 37 which shows an elevator 650 that is aligned with the axis of gravity and utilizes curvilinear card face support surfaces. Shuffler 600 utilizes the same card transport 120 as the previous embodiments and adopts an elevator assembly 650 whose axis is aligned with gravity as show by arrow 651. The elevator is powered by the same lead screw 166 and stepper motor 162 as was explained in the earlier embodiments (see FIG. 15). The same shutter 282, retainer 270, and shutter actuation components are utilized in this embodiment as was shown in FIG. 31. Arrow 651 indicates the axis of the elevator motion and arrow 688 indicates the direction of the inertial forces which are utilized to move the substacks to the discharge tray 72. The curvilinear elevator nests may be utilized in all of the other embodiments.

Product improvement goals are met when a product redesign effort yields a new product that is smaller, cheaper or faster. The low-cost hand-forming shuffler designs as described herein achieve all three of those goals in comparison to the referenced art. These shuffler configurations are more compact (smaller) because they utilize fewer compartments. Whereas the cited prior art utilizes five (5) or six (6) motors, the preferred embodiment herein utilizes just two (2) motors. Manufacturing cost is reduced (lower cost) by elimination of the motor-driven pusher mechanisms and the electronic infrastructure associated with each motor. The shuffler embodiments disclosed herein are faster because they utilize smaller, quicker excursions while delivering formed hands or residual cards to the output portal.

One of ordinary skill, having designer's choice, may choose to utilize forms of actuators and/or transport components which are different than those described herein. Other forms of transport components, including cables, gears, chains and other types of belts may be substituted for those described herein. Other types of motors and solenoids are also logical substitutions. Altering the number and size of the nests is also a designer's choice in configuring these embodiments. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the embodiments herein.

What is claimed is:

1. A card handing device for shuffling playing cards in a casino comprising:

a housing;

a control panel positioned on the exterior of the housing;

an unshuffled card input portal comprising a card receiving cavity;

a shuffled card discharge portal comprising a card discharge cavity;

an elevator having a plurality of card storage nests;

each of the plurality of nests having an exit orifice and an entrance orifice;

each nest having a card face support surface angularly sloped away from the direction of gravity;

at least one microcontroller responsive to the control panel;

a motor that moves the elevator incrementally and bidirectionally amongst the nest elevations while producing an inertial force;

a card transport that moves cards from the input portal to the elevator nests in the direction of the substack inertial force;

at least one retainer that retains cards within the elevator in opposition to the inertial force;

the card edges within each nest being aligned by the retainer; and wherein the card handing device moves cards into the nests and out of the nests in the same inertial force direction; and wherein the card handing device moves play-ready substacks from the nests to the discharge cavity by inertial force; and wherein the card handing device possesses at least one straight line path operable for moving cards directly from the input portal to the output portal.

2. The card handling device of claim 1 further comprising:

a pivotable retainer in each nest.

3. The card handling device of claim 1 having a stationary retainer which retains the cards in all nests.

4. The card handling device of claim 1 whereupon at least one of the card storage nests has the exit orifice being smaller than the corresponding entrance orifice.

5. The card handling device of claim 1 wherein the card transport rotates the axis of each card while the card is entered into the nest.

6. The card handling device of claim 1 whereupon the card storage nests each have a card face support surface that is flat.

7. The card handling device of claim 1 whereupon the card storage nests each have a card face support surface that is curvilinear.

8. The card handling device of claim 1 having no more than two motors.

9. The card handling device of claim 1 wherein a number of cards delivered to the output portal is programmable.

10. The card handling device of claim 1 further comprising:

the microcontroller configured to count a number of cards moved from the input portal to the output portal.

11. The microcontroller of claim 10 that signals an error condition when the card count deviates from a previously programmed parameter.

12. The card handling device of claim 1 further comprising:

a single motor configured to move individual cards from the input portal to the output portal.

13. A card handing device for shuffling playing cards in a casino comprising:

a housing;

a control panel positioned on the exterior of the housing;

an unshuffled card input portal comprising a card receiving cavity;

a shuffled card discharge portal comprising a card discharge cavity;

an elevator having a plurality of card storage nests;

each of the plurality of nests having an exit orifice and an entrance orifice;

each nest having a card face support surface angularly sloped away from the direction of gravity;

at least one microcontroller responsive to the control panel;

a motor that moves the elevator incrementally and bidirectionally amongst the nest elevations while producing substack inertial force;

a card transport that moves cards from the input portal to the elevator nests in the direction of the substack inertial force;

at least one retainer that retains cards within the elevator in opposition to the substack inertial force;

the card edges within each nest being aligned by the retainer; and wherein the card handing device moves cards into the nests and out of the nests in the same inertial force direction; and wherein the card handing device moves one or more play-ready substacks from the nests to the discharge cavity solely by gravity; and wherein the card handing device possesses at least one direct path operable for moving cards directly from the input portal to the output portal.

14. The card handling device of claim 13 further comprising:

a pivotable retainer in each nest.

15. The card handling device of claim 13 having a stationary retainer which retains the cards in all nests.

16. The card handling device of claim 13 whereupon at least one of the card storage nests has an exit orifice that is smaller than the corresponding entrance orifice.

17. The card handling device of claim 13 wherein the card transport rotates the axis of each card while the card is entered into the nest.

18. The card handling device of claim 13 whereupon the card storage nests each have a card face support surface that is flat.

19. The card handling device of claim 13 whereupon the card storage nests each have a card face support surface that is curvilinear.

20. The card handling device of claim 13 having no more than two motors.

21. The card handling device of claim 13 wherein a number of cards delivered to the output portal is predetermined.

22. The card handling device of claim 13 further comprising:

the microcontroller being configured to count a number of cards moved from the input portal to the output portal.

23. The microcontroller of claim 22 being configured to signal an error condition when the card count deviates from a previously programmed parameter.

24. The card handling device of claim 13 further comprising:

a single motor configured to move individual cards from the input portal to the output portal.

* * * * *